US007833114B2

(12) United States Patent
Schneider

(10) Patent No.: US 7,833,114 B2
(45) **Date of Patent: *Nov. 16, 2010**

(54) LOW GROUND RESISTANCE GOLF TEE

(76) Inventor: Mark Allen Schneider, 17 Rockwood Forest Glen, Wildwood, MO (US) 63025

( * ) Notice: Subject to any disclaimer, the term of this patent is extended or adjusted under 35 U.S.C. 154(b) by 0 days.

This patent is subject to a terminal disclaimer.

(21) Appl. No.: 12/349,400

(22) Filed: Jan. 6, 2009

(65) Prior Publication Data

US 2010/0173731 A1 Jul. 8, 2010

Related U.S. Application Data

(60) Provisional application No. 61/020,855, filed on Jan. 14, 2008.

(51) Int. Cl.
*A63B 57/00* (2006.01)

(52) U.S. Cl. ..... 473/387; 473/402

(58) Field of Classification Search ..... 473/387–403; D21/717, 718

See application file for complete search history.

(56) References Cited

U.S. PATENT DOCUMENTS

| | | | | | |
|---|---|---|---|---|---|
| 1,623,782 | A | * | 4/1927 | Dent et al. | 473/392 |
| 1,692,191 | A | * | 11/1928 | Towsley | 473/400 |
| 1,783,211 | A | | 12/1930 | Baldwin | |
| 2,018,146 | A | * | 10/1935 | Penny | 473/402 |
| 2,082,811 | A | * | 6/1937 | Thorup | 473/402 |
| 2,456,511 | A | | 12/1948 | Siegfried | |
| D210,837 | S | | 4/1968 | Warner | |
| D219,347 | S | | 12/1970 | Letts | |
| 4,192,504 | A | * | 3/1980 | Clugage | 473/257 |
| 4,205,841 | A | * | 6/1980 | Silva et al. | 473/257 |
| 4,328,969 | A | | 5/1982 | Wright | |
| 4,838,285 | A | | 6/1989 | Petrone | |
| D308,086 | S | * | 5/1990 | Gamble | D21/718 |
| 4,951,945 | A | * | 8/1990 | Gamble | 473/400 |
| 5,149,088 | A | * | 9/1992 | O'Hara | 473/396 |
| D331,271 | S | | 11/1992 | Blake | |
| 5,413,330 | A | | 5/1995 | Disco et al. | |
| D385,939 | S | | 11/1997 | Suk | |

(Continued)

FOREIGN PATENT DOCUMENTS

| | | | |
|---|---|---|---|
| GB | 2403911 | A | 1/2005 |

*Primary Examiner*—Steven Wong
(74) *Attorney, Agent, or Firm*—Gallagher & Dawsey Co., LPA; Michael J. Gallagher; David J. Dawsey

(57) ABSTRACT

A low ground resistance golf tee for insertion into a playing surface to support a golf ball above the playing surface to be struck by a golf club launching the golf ball in a flight direction is provided. The golf tee includes a body having an impact side, a release side, an insertion end, and a ball support end. The golf tee has a low exit resistance region that includes a low exit resistance region insertion edge for penetrating and separating the playing surface to create a preferred exit path for the low exit resistance region upon impact by the golf club. The golf tee further includes a stem region located between the low exit resistance region and the ball support end, which is designed to be displayed above the playing surface. Upon impact, the golf tee pivots forward in the flight direction with minimal resistance from the playing surface.

19 Claims, 25 Drawing Sheets

U.S. PATENT DOCUMENTS

| | | | | |
|---|---|---|---|---|
| 5,683,313 | A | 11/1997 | Disco et al. | |
| D398,361 | S | 9/1998 | DiCesari et al. | |
| 6,004,228 | A * | 12/1999 | Adam | 473/403 |
| 6,053,822 | A | 4/2000 | Kolodney et al. | |
| 6,062,990 | A * | 5/2000 | Pierce | 473/387 |
| 6,176,794 | B1 * | 1/2001 | Kim | 473/402 |
| 6,280,350 | B1 | 8/2001 | Chung | |
| D453,810 | S | 2/2002 | Lee | |
| 6,428,429 | B1 | 8/2002 | Lee | |
| D492,743 | S | 7/2004 | Boyarko | |
| 7,052,416 | B2 | 5/2006 | Chang | |
| 7,140,982 | B2 | 11/2006 | Park | |
| D535,347 | S | 1/2007 | Cialdella et al. | |
| D592,713 | S * | 5/2009 | Schneider | D21/717 |
| 2007/0270246 | A1 | 11/2007 | Salmon | |

* cited by examiner

*Fig. 25*
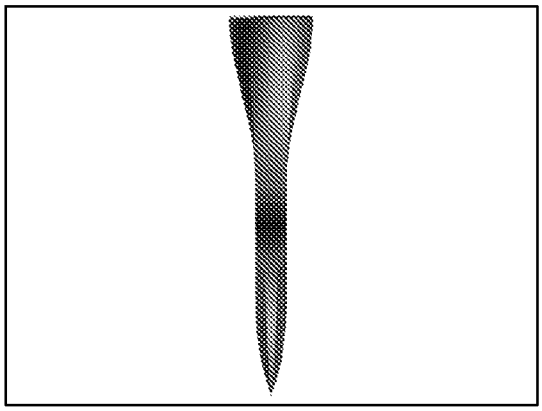
*Fig. 26*
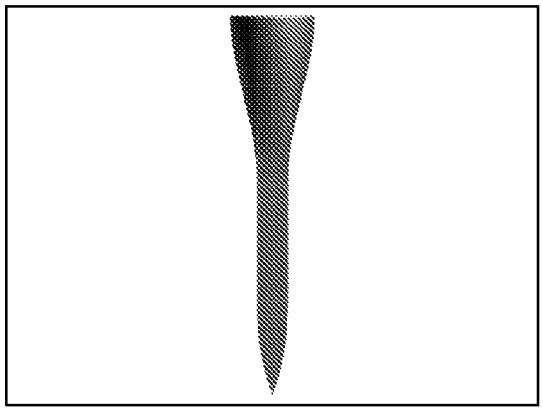
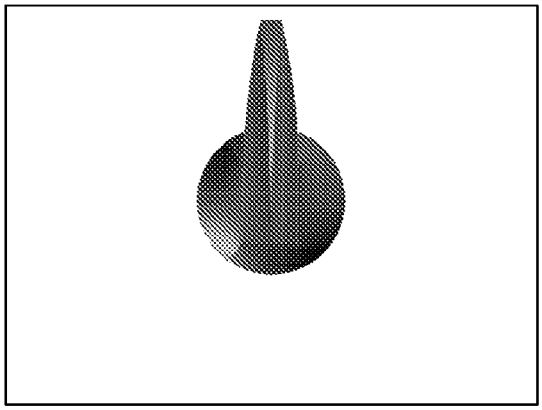
*Fig. 27*
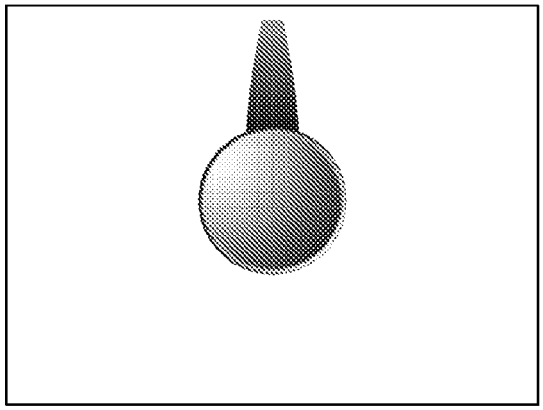
*Fig. 28*

*Fig. 31*
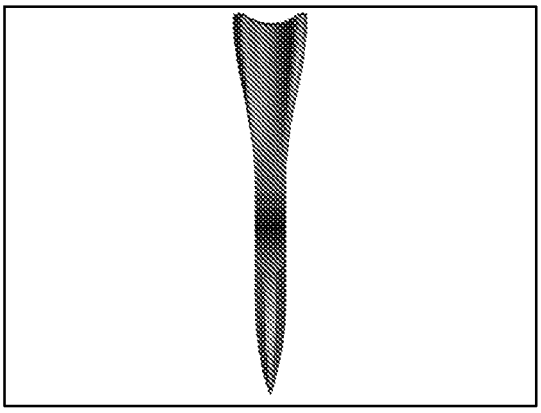
*Fig. 32*
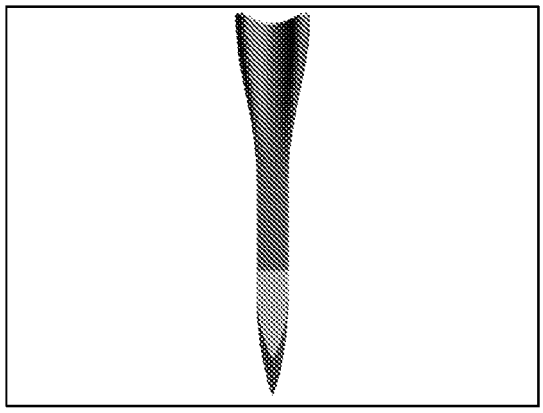
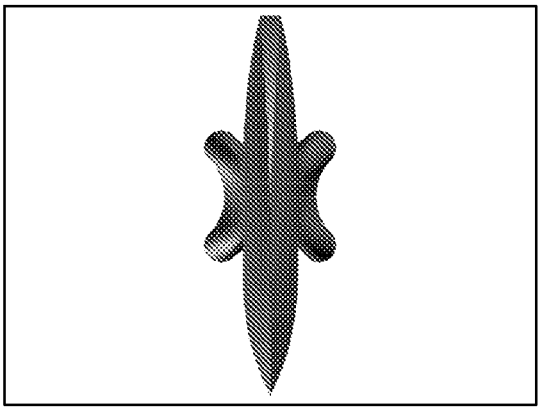
*Fig. 33*
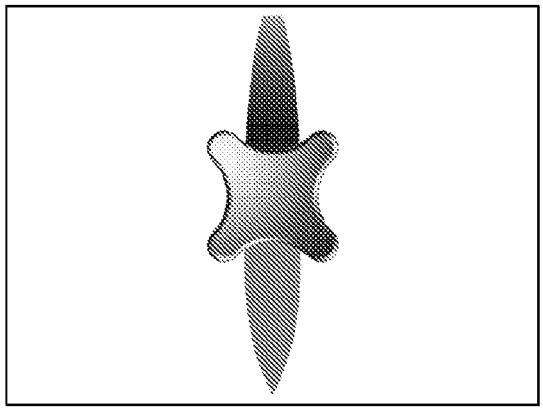
*Fig. 34*

*Fig. 37*
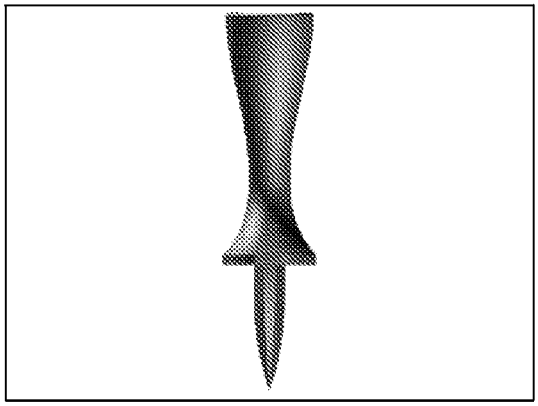
*Fig. 38*
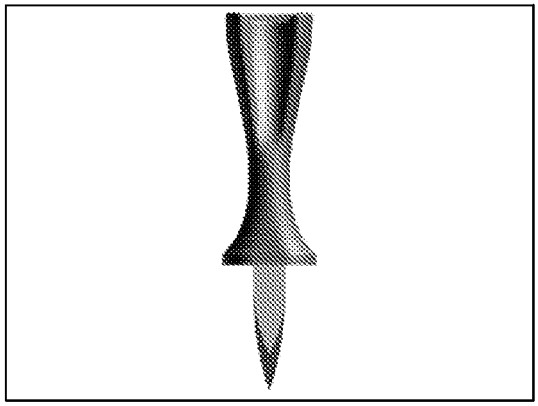
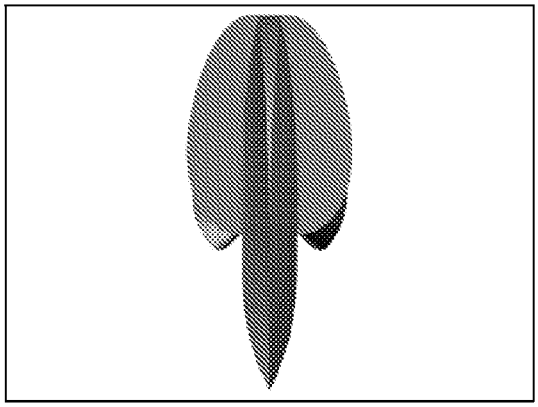
*Fig. 39*
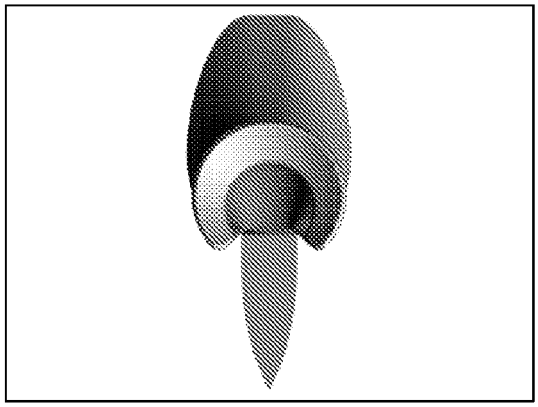
*Fig. 40*

*Fig. 43*
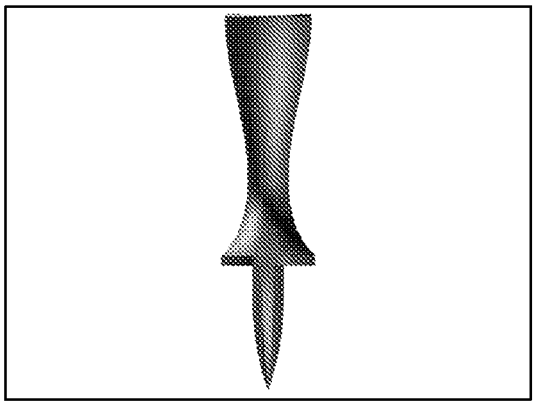
*Fig. 44*
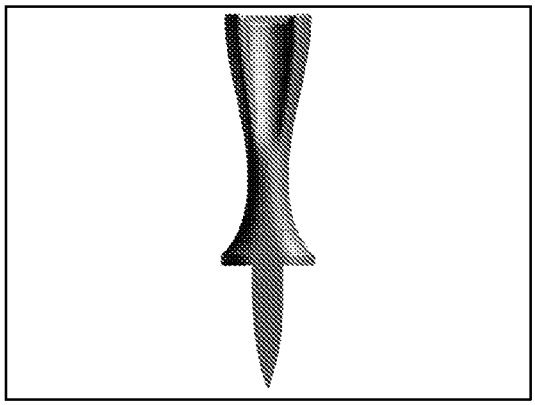
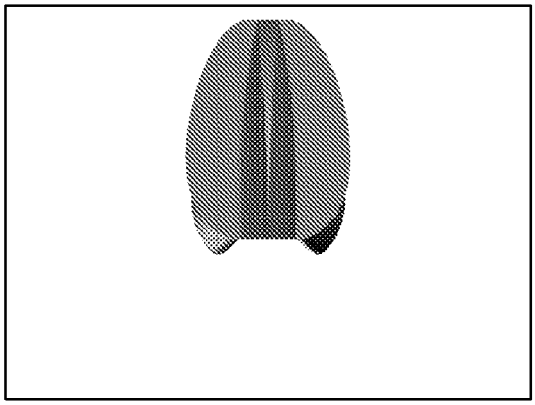
*Fig. 45*
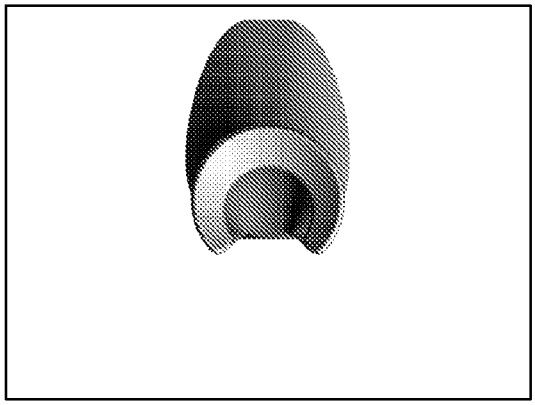
*Fig. 46*

*Fig. 49*
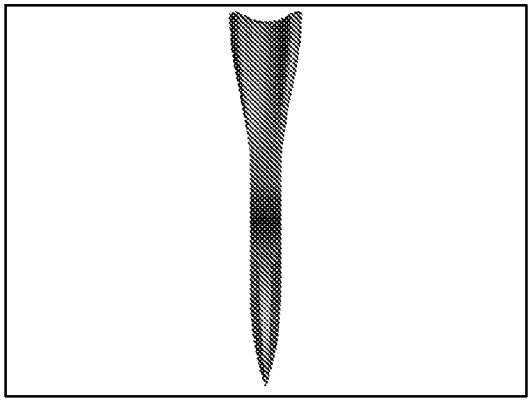
*Fig. 50*
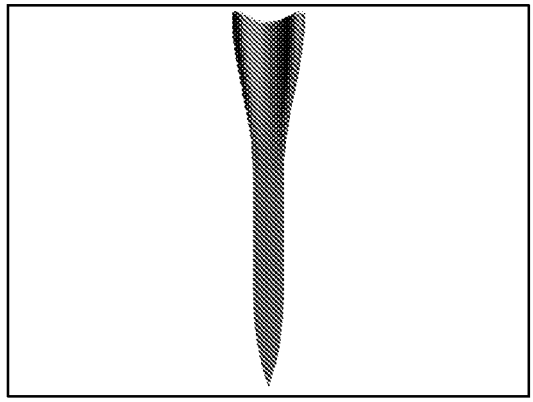
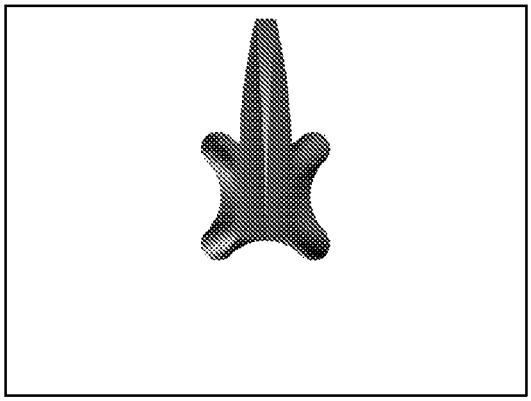
*Fig. 51*
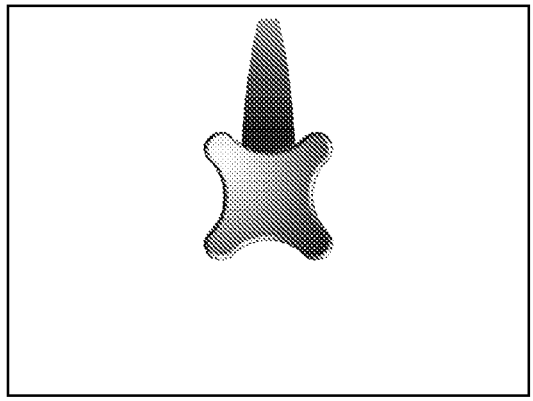
*Fig. 52*

LOW GROUND RESISTANCE GOLF TEE

CROSS-REFERENCE TO RELATED APPLICATIONS

This application claims the benefit of U.S. provisional patent application Ser. No. 61/020,855, filed on Jan. 14, 2008, all of which is incorporated by reference as if completely written herein.

TECHNICAL FIELD

The present invention relates to sports equipment, and more particularly to a low ground resistance golf tee for insertion into a playing surface to support a golf ball to be struck by a golf club.

BACKGROUND OF THE INVENTION

Golf tees are an often overlooked piece of equipment in the game of golf. Many golfers think of golf tees as simply a device for elevating a golf ball above a playing surface without giving any thought to the effect that a golf tee has on the flight of the golf ball. This fact explains why today's golfers still use the same wooden golf tee utilized by golfers of decades past.

Conventional wooden golf tees have several drawbacks. First, conventional wooden golf tees have a tendency to break upon impact by a golf club. Second, wooden golf tees can be particularly difficult to insert into firm, dry playing surfaces. In fact, many wooden golf tees have a tendency to break when trying to insert them into firm, dry playing surfaces. Third, conventional wooden golf tees, due to their mass being concentrated towards the ball supporting end, have a tendency to fly relatively far away from the original teeing location. Finally, conventional tees provide some amount of resistance against a golf ball and a golf club at impact that may adversely affect the flight of the golf ball.

Prior art golf tees have failed to account for all of these drawbacks. Thus, there remains a need to provide a golf tee that is not prone to breaking and is easily inserted into all types of playing surfaces, while at the same time providing reduced resistance and a propensity to fly only a relatively short distance from the original teeing location.

SUMMARY OF THE INVENTION

In its most general configuration, the present invention advances the state of the art with a variety of new capabilities and overcomes many of the shortcomings of prior devices in new and novel ways. The present invention overcomes the shortcomings and limitations of the prior art in any of a number of generally effective configurations. The instant invention demonstrates such capabilities and overcomes many of the shortcomings of prior methods in new and novel ways.

The present invention is a low ground resistance golf tee for insertion into a playing surface to support a golf ball to be struck by a golf club launching the golf ball in a flight direction. The low ground resistance golf tee is designed to pivot forward in the flight direction with minimal resistance when struck by the golf club, or when the golf ball is struck by the golf club, while still providing a stable platform for elevating the golf ball above the playing surface. The low ground resistance golf tee is also designed to minimize the final distance that the low ground resistance golf tee comes to rest from the initial teeing location.

Generally, the low ground resistance golf tee has a body having an impact side, a release side, an insertion end, and a ball support end. The insertion end and the ball support end are separated from the insertion end by a tee length having a tee midpoint equidistant from the insertion end and the ball support end. The body has a center of gravity and a longitudinal axis, wherein the longitudinal axis is a vertical axis extending through a center of the golf ball when supported by the golf tee.

The low ground resistance golf tee includes two regions: a low exit resistance region and a stem region. The low exit resistance region is located between the tee midpoint and the insertion end and at least a portion of the low exit resistance region is designed to penetrate the playing surface, whereas the stem region is meant to be above the playing surface.

The low exit resistance region includes a LERR insertion edge and a LERR translation resistance surface. The LERR insertion edge is designed to penetrate and separate the playing surface when the low ground resistance golf tee is forced vertically into the playing surface. Additionally, the LERR insertion edge creates a preferred exit path for the low exit resistance region as it slices through the playing surface. The LERR translation resistance surface intersects with the LERR insertion edge. In addition, the LERR translation resistance surface is oriented at a translation resistance surface angle with respect to the longitudinal axis. In some embodiments the translation resistance surface angle may be zero, while in other embodiments, the translation resistance surface angle may be greater than zero.

The stem region is located between the low exit resistance region and the ball support end. The stem region is designed to be displayed above the playing surface and is characterized by a stem region length. Additionally, the stem region has a stem region minimum width and a stem region minimum front-to-back dimension. The stem region further includes a stem region translation resistance surface in communication with the LERR translation resistance surface. In addition, the stem region includes a SR transition region that joins the LERR insertion edge to the stem region.

Numerous variations, modifications, alternatives, and alterations of the various preferred embodiments, processes, and methods may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

FIG. 25 is an impact side elevation view of one embodiment of the present invention, not to scale;

FIG. 26 is a rebound side elevation view of one embodiment of the present invention, not to scale;

FIG. 27 is a bottom plan view of one embodiment of the present invention, not to scale;

FIG. 28 is a top plan view of one embodiment of the present invention, not to scale;

FIG. 31 is an impact side elevation view of one embodiment of the present invention, not to scale;

FIG. 32 is a rebound side elevation view of one embodiment of the present invention, not to scale;

FIG. 33 is a bottom plan view of one embodiment of the present invention, not to scale;

FIG. 34 is a top plan view of one embodiment of the present invention, not to scale;

FIG. 37 is an impact side elevation view of one embodiment of the present invention, not to scale;

FIG. 38 is a rebound side elevation view of one embodiment of the present invention, not to scale;

FIG. 39 is a bottom plan view of one embodiment of the present invention, not to scale;

FIG. 40 is a top plan view of one embodiment of the present invention, not to scale;

FIG. 43 is an impact side elevation view of one embodiment of the present invention, not to scale;

FIG. 44 is a rebound side elevation view of one embodiment of the present invention, not to scale;

FIG. 45 is a bottom plan view of one embodiment of the present invention, not to scale;

FIG. 46 is a top plan view of one embodiment of the present invention, not to scale;

FIG. 49 is an impact side elevation view of one embodiment of the present invention, not to scale;

FIG. 50 is a rebound side elevation view of one embodiment of the present invention, not to scale;

FIG. 51 is a bottom plan view of one embodiment of the present invention, not to scale;

FIG. 52 is a top plan view of one embodiment of the present invention, not to scale;

Figure 1:
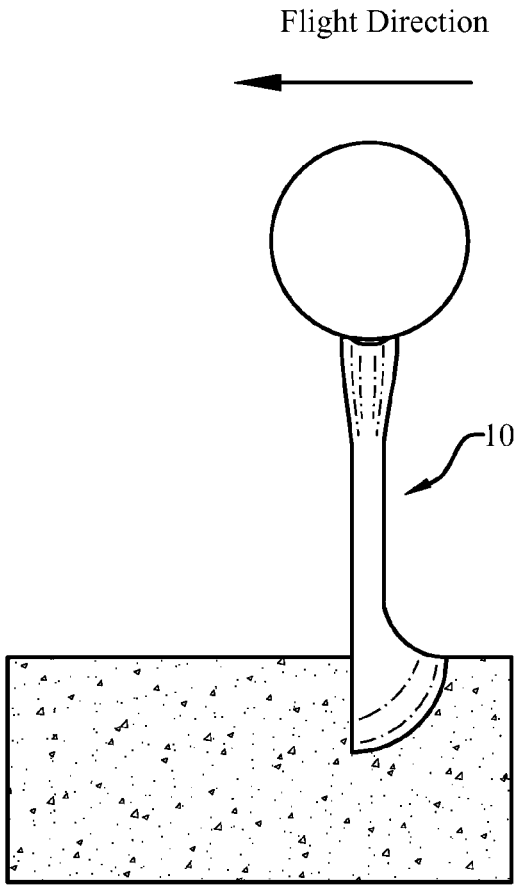
FIG. 1 is a side elevation view of one embodiment of the present invention, not to scale.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The present invention includes a low ground resistance golf tee (10). The invention enables a significant advance in the state of the art. The preferred embodiments of the apparatus accomplish this by new and novel methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 2:
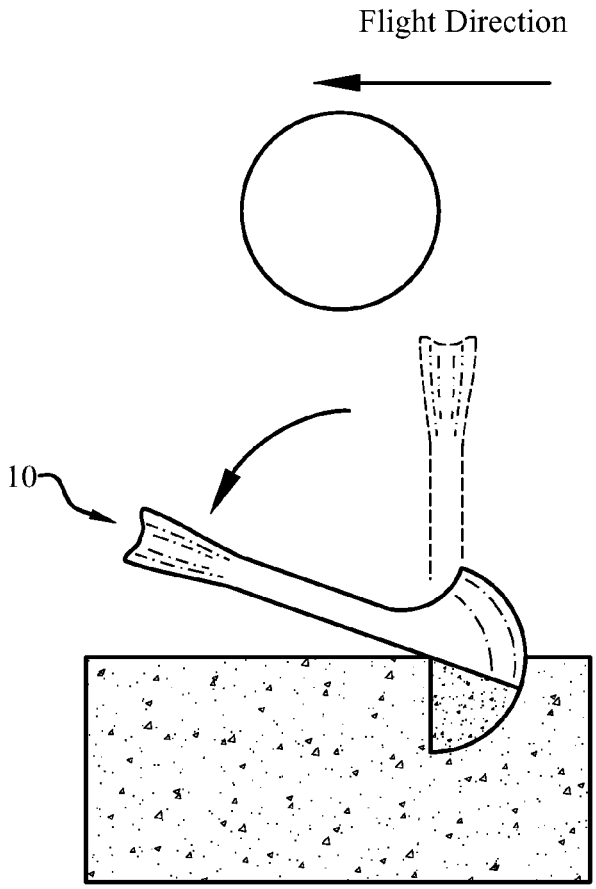
FIG. 2 is a side elevation view of one embodiment of the present invention, not to scale.

The present invention is a low ground resistance golf tee (10) for insertion into a playing surface to support a golf ball to be struck by a golf club launching the golf ball in a flight direction, as seen in FIG. 1. The present invention is designed to pivot forward, as seen in FIG. 2, in the flight direction with minimal resistance when struck by the golf club, or when the golf ball is struck by the golf club. Prior art golf tees have overlooked the benefits of engineering a golf tee that pivots forward in the direction of the ball's flight as easily as possible, while still providing a stable platform for elevating the golf ball above the playing surface. The present invention provides such benefits, while also minimizing the final distance that the low ground resistance golf tee (10) comes to rest from the initial teeing location, by discovering several unique relationships that the prior art has failed to recognize and understand.

Figure 3:
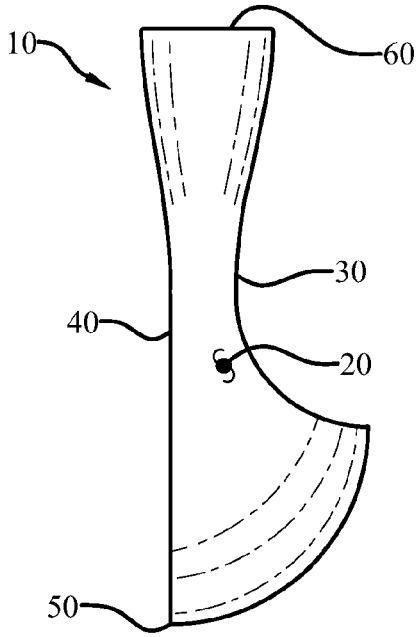
FIG. 3 is a side elevation view of one embodiment of the present invention, not to scale.
Figure 4:
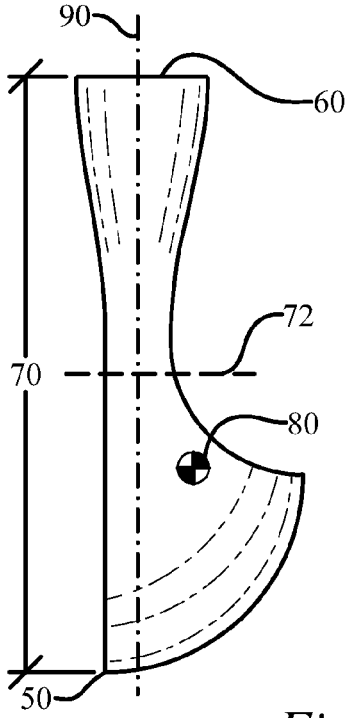
FIG. 4 is a side elevation view of one embodiment of the present invention, not to scale.

With reference now to FIG. 3, the low ground resistance golf tee (10) has a body (20) having an impact side (30), a release side (40), an insertion end (50), and a ball support end (60). The insertion end (50) and the ball support end (60) are separated from the insertion end (50) by a tee length (70) having a tee midpoint (72) equidistant from the insertion end (50) and the ball support end (60), as seen in FIG. 4. The body (20) having a center of gravity (80) and a longitudinal axis (90) wherein the longitudinal axis (90) is a vertical axis extending through a center of the golf ball when supported by the golf tee (10).

Figure 5:
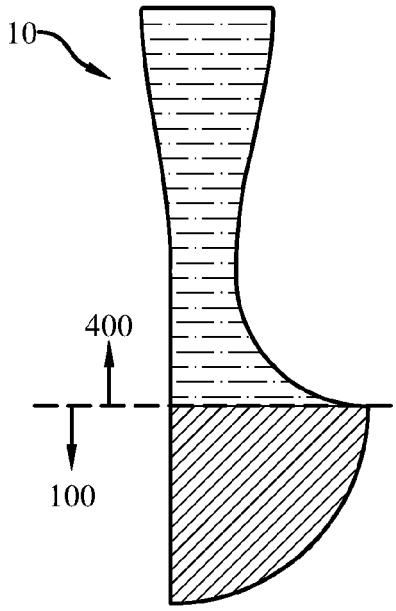
FIG. 5 is a side elevation view of one embodiment of the present invention, not to scale.

The low ground resistance golf tee (10) is divided into two regions; namely a low exit resistance region (100) and a stem region (400), as seen in FIG. 5. The low exit resistance region (100) is located between the tee midpoint (72) and the insertion end (50) and at least a portion of the low exit resistance region (100) is designed to penetrate the playing surface, whereas the stem region is meant to be above the playing surface.

Focusing first on the low exit resistance region (100), it includes a LERR insertion edge (200) and a LERR translation resistance surface (300). It should be noted at this point that the abbreviation LERR is used throughout to abbreviate the words "Low Exit Resistance Region" when they are used as in the terminology of another element, thus LERR insertion edge (200) may also be referred to as the low exit resistance region insertion edge (200).

Figure 7:
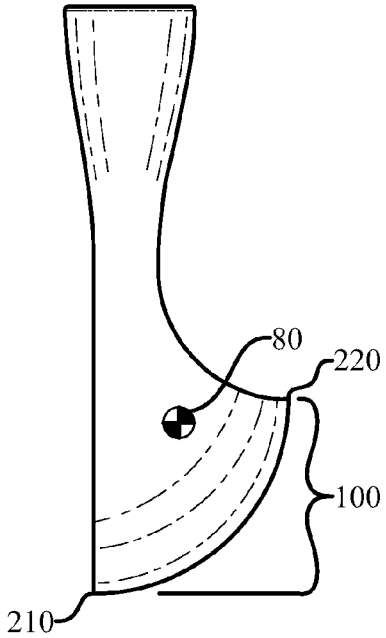
FIG. 7 is a side elevation view of one embodiment of the present invention, not to scale.
Figure 8:
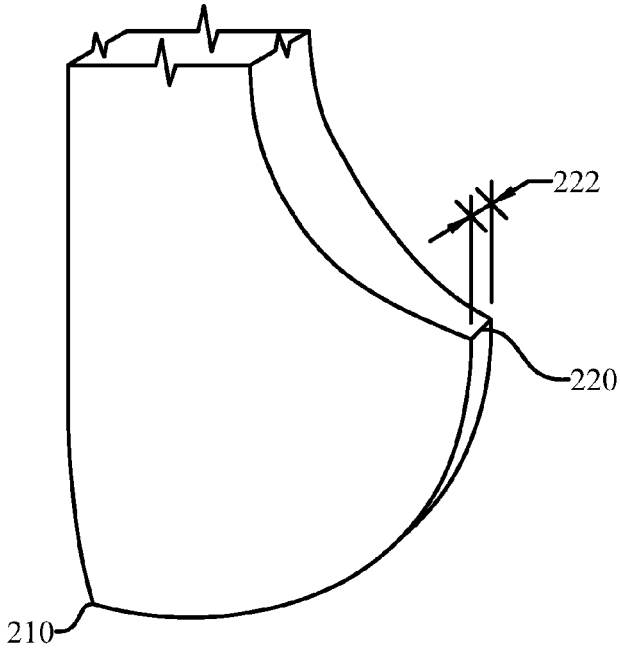
FIG. 8 is a partial perspective view of a portion of one embodiment of the present invention, not to scale.

The LERR insertion edge (200) is designed to penetrate and separate the playing surface when the low ground resistance golf tee (10) is forced vertically into the playing surface. The LERR insertion edge (200) creates a preferred exit path for the low exit resistance region (100) as it slices through the playing surface. This preferred exit path is formed and allows the pivoting action that was previously described. The LERR insertion edge (200) includes a leading insertion point (210) and an insertion edge aft termination point (220), as seen in FIG. 7. The leading insertion point (210) is the furthest most point on the insertion end (50) and enters the playing surface first when the golf tee (10) is forced vertically down into the playing surface. The insertion edge aft termination point (220) is at the termination of the LERR insertion edge (200). Both insertion edge points (210, 220) have an associated width. For instance, the leading insertion point (210) has a leading insertion width (212); and the insertion edge aft termination point (220) has an insertion edge aft termination width (222). The enlarged perspective view of the embodiment of FIG. 8 nicely illustrates the insertion edge aft termination width (222). In the embodiment of FIG. 8, the LERR insertion edge (200) transitions from having a distinct thickness at the insertion edge aft termination point (220) to a knife-edge type configuration at the leading insertion point (210), yet one skilled in the art will appreciate that the leading insertion point (210) still has a leading insertion width (212) just as the tip, or edge, of a fine knife or sword still has a width, as seen in the front elevation view of the low exit resistance region (100) seen in FIG. 9 and the rear elevation view of the low exit resistance region (100) seen in FIG. 10.

Figure 6:
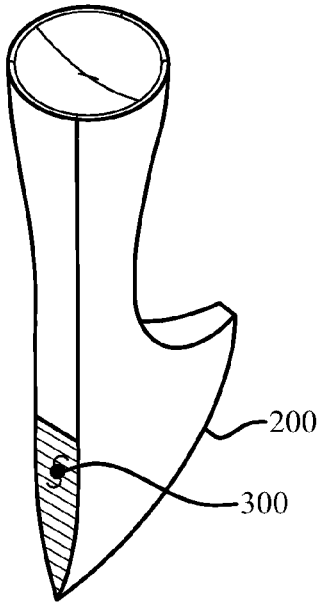
FIG. 6 is an elevated perspective view of one embodiment of the present invention, not to scale.
Figure 9:
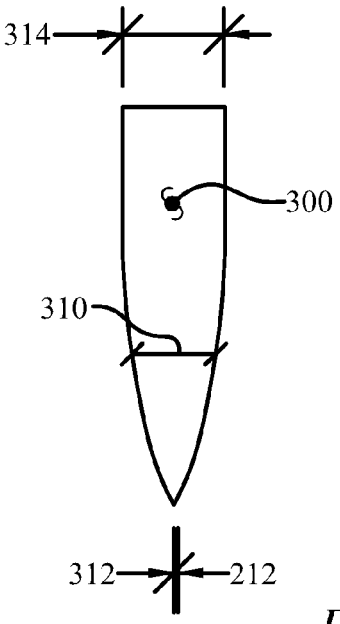
FIG. 9 is a partial release side elevation view of one embodiment of the present invention, not to scale.
Figure 10:
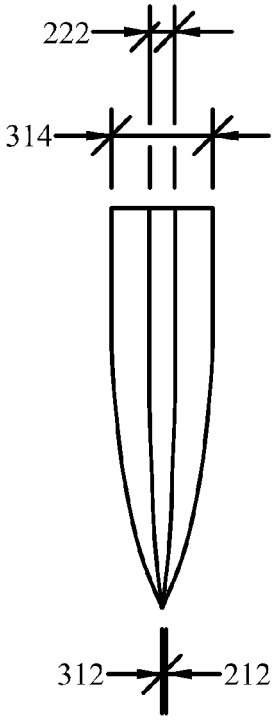
FIG. 10 is a partial impact side elevation view of one embodiment of the present invention, not to scale.

As seen in FIGS. 6 and 9, the LERR translation resistance surface (300) intersects with the LERR insertion edge (200). The LERR translation resistance surface (300) has a LERR translation resistance surface width (310), seen best in FIG. 9. Inherently, at one point the LERR translation resistance surface (300) has a minimum LERR resistance surface width (312), while at some other point has a maximum LERR resistance surface width (314). In the particular embodiment of FIGS. 8, 9, and 10, the LERR translation resistance surface width (310) has a maximum LERR resistance surface width (314) at the top of the low exit resistance region (100) and transitions to the minimum LERR resistance surface width (312) at the point that the LERR translation resistance surface (300) intersects with the LERR insertion edge (200); thus, in this particular embodiment the knife-edge thickness that represents the leading insertion width (212) is also the minimum LERR resistance surface width (312).

Figure 11:
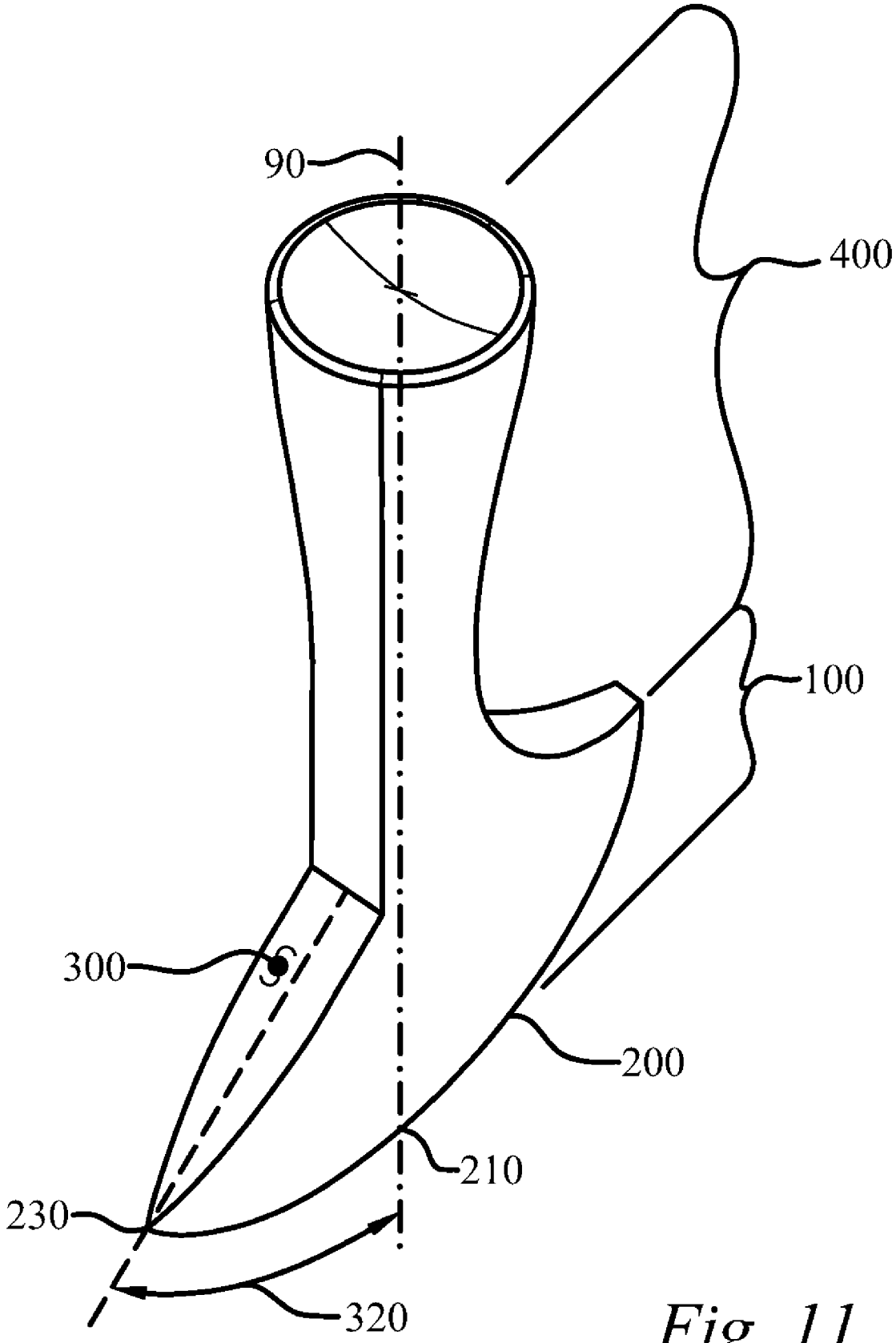
FIG. 11 is an elevated perspective view of one embodiment of the present invention, not to scale.

The LERR translation resistance surface (300) is oriented at a translation resistance surface angle (320) with respect to the longitudinal axis (90). In the embodiments of FIGS. 1-10 the translation resistance surface angle (320) has been zero because the surface has been parallel to the longitudinal axis (90); however, that is not the case in FIG. 11. The low exit resistance region (100) of the embodiment of FIG. 11 includes a distinct forward projection leading to a LERR translation resistance surface (300) that has a translation resistance surface angle (320) of greater than zero, or approximately 45 degrees in this embodiment. This particular embodiment gives rise to a couple of additional elements to further characterize the LERR insertion edge (200); namely an insertion edge forward termination point (230) having an insertion edge forward termination point width (232). These additional elements are needed to define the LERR insertion edge (200) in this embodiment because the previously defined leading insertion point (210), also seen in FIG. 11, is the first point on the LERR insertion edge (200) that comes in contact with the playing surface as the low ground resistance golf tee (10) is vertically forced into the playing surface. Thus, in the embodiments shown in FIGS. 1-10 the leading insertion point (210) just happened to also be the forward termination point of the LERR insertion edge (200), or fittingly referred to as the insertion edge forward termination point (230).

Figure 12:
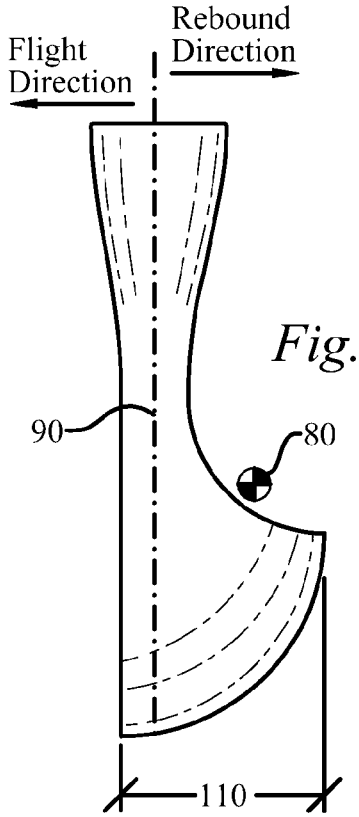
FIG. 12 is a side elevation view of one embodiment of the present invention, not to scale.
Figure 13:
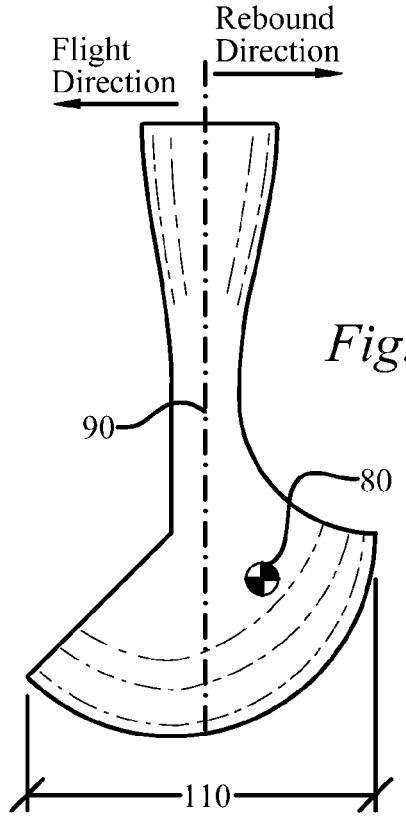
FIG. 13 is a side elevation view of one embodiment of the present invention, not to scale.

Now, with reference to FIGS. 12 and 13, a few more characteristics of the present invention must be defined to further identify unique and novel aspects of the low ground resistance golf tee (10). The LERR max front-to-back dimension (110) is measured in a direction perpendicular to the longitudinal axis (90) from the point of the low exit resistance region (100) farthest from the longitudinal axis (90) in the flight direction, to the point of the low exit resistance region (100) farthest from the longitudinal axis (90) in a rebound direction, thus opposite the flight direction.

Figure 14:
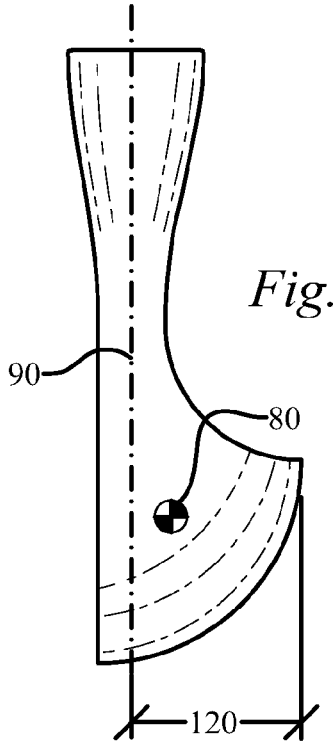
FIG. 14 is a side elevation view of one embodiment of the present invention, not to scale.
Figure 15:
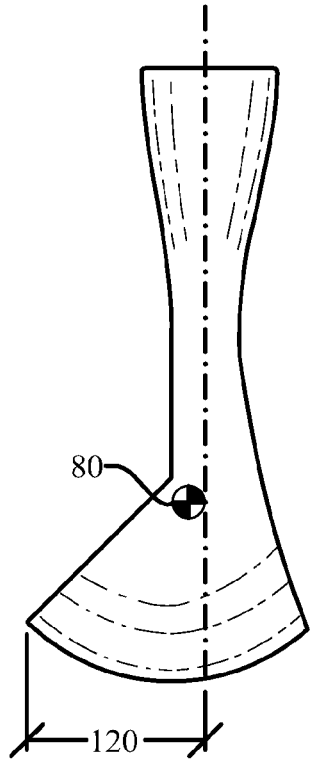
FIG. 15 is a side elevation view of one embodiment of the present invention, not to scale.

Additionally, now referring to FIGS. 14 and 15, a LERR max projection from longitudinal axis dimension (120) is a dimension measured in a direction perpendicular to the longitudinal axis (90) from the longitudinal axis (90) to the most distant point on the low exit resistance region (100). The embodiment of FIG. 15 is dramatically different than the embodiment of FIG. 14, illustrating that the LERR max projection from longitudinal axis dimension (120) need not inherently be in the flight direction or the rebound direction.

Figure 16:
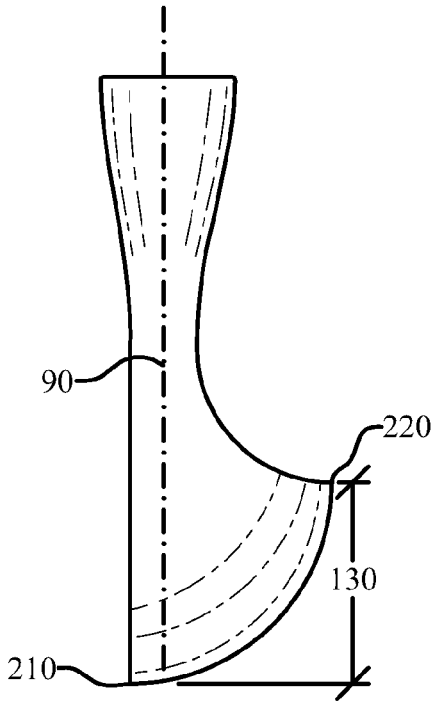
FIG. 16 is a side elevation view of one embodiment of the present invention, not to scale.
Figure 17:
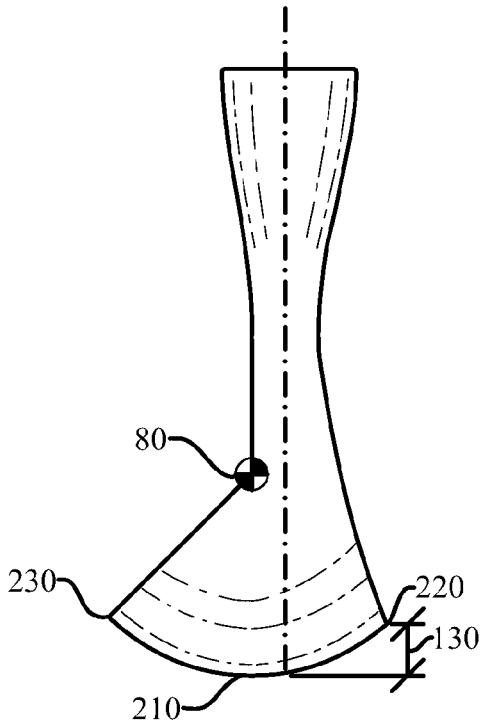
FIG. 17 is a side elevation view of one embodiment of the present invention, not to scale.

Further, with reference now to FIGS. 16 and 17, the low exit resistance region (100) has a LERR max projection stem-to-tip dimension (130) measured in a direction parallel to the longitudinal axis (90) from the leading insertion point (210) to the insertion edge aft termination point (220).

Figure 18:
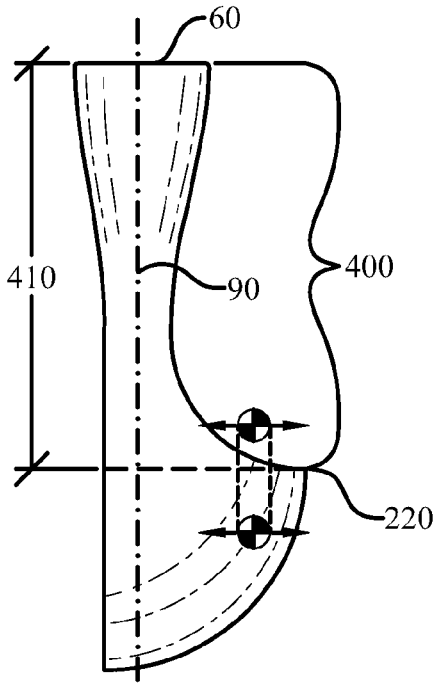
FIG. 18 is a side elevation view of one embodiment of the present invention, not to scale.
Figure 19:
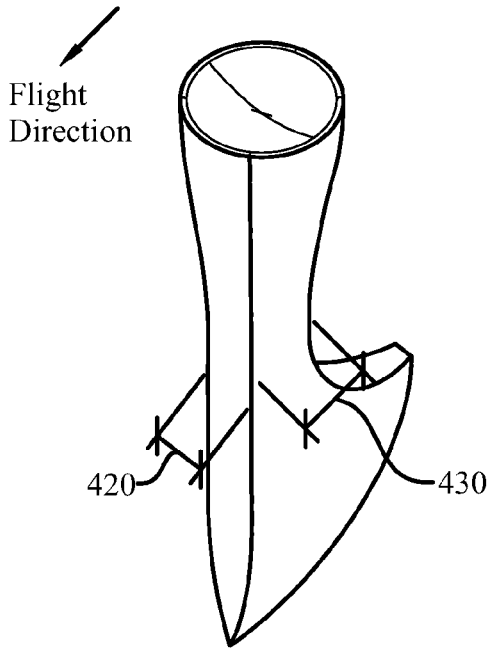
FIG. 19 is an elevated perspective view of one embodiment of the present invention, not to scale.

Now a closer look at the stem region (400) is in order. With reference again to FIG. 5, the stem region (400) is located between the low exit resistance region (100) and the ball support end (60). The stem region (200) is designed to be displayed above the playing surface and is characterized by a stem region length (410) measured in a direction parallel to the longitudinal axis (90) from the insertion edge aft termination point (220) to the ball support end (60), as seen in FIG. 18. Further, as seen in FIG. 19, the stem region (400) has a stem region minimum width (420) measured in a direction perpendicular to the flight direction. Additionally, the stem region (400) has a stem region minimum front-to-back dimension (430) measured in a direction parallel to the flight direction.

Figure 20:
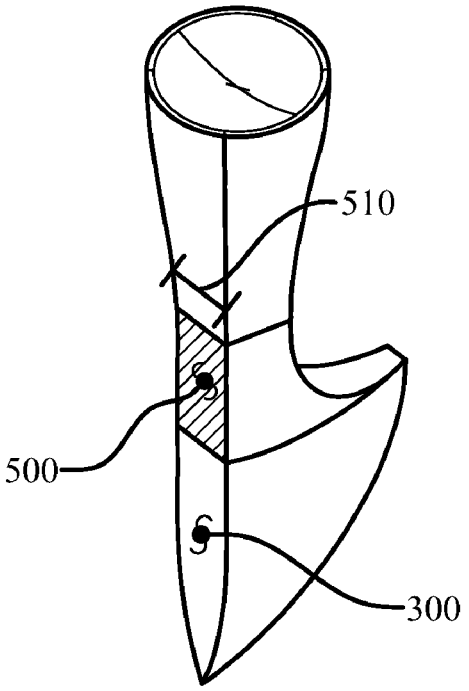
FIG. 20 is an elevated perspective view of one embodiment of the present invention, not to scale.

Similar to the low exit resistance region (100), the stem region (400) includes a stem region translation resistance surface (500), illustrated as the cross-hatched region of FIG. 20, in communication with the LERR translation resistance surface (300). The stem region translation resistance surface (500) has a stem region translation resistance surface width (510) and a minimum SR resistance surface width, not shown but understood by one skilled in the art. It should be noted at this point that the abbreviation SR is used throughout to abbreviate the words "Stem Region" when they are used as in the terminology of another element, thus minimum SR resistance surface width may also be referred to as the minimum stem region resistance surface width.

Figure 21:
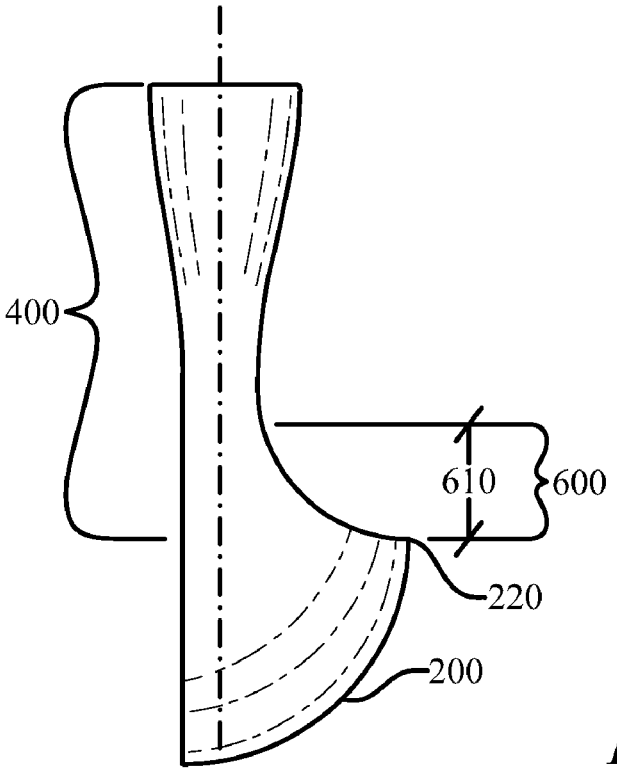
FIG. 21 is a side elevation view of one embodiment of the present invention, not to scale.

Further, as seen in FIG. 21, the stem region (400) includes a SR transition region (600) joining the LERR insertion edge (200) to the stem region (400). The SR transition region (600) has a transition region height (610) measured in a direction parallel to the longitudinal axis (90) from insertion edge aft termination point (220) toward the ball support end (60) to the point at which the stem region minimum front-to-back dimension (430) occurs.

Now, a majority of the basic elements and definitions required to adequately disclose the present invention have been identified and defined. Next, the functioning of the low ground resistance golf tee (10) and numerous embodiments will be described. With reference again to FIGS. 1 and 2, the low ground resistance golf tee (10) is inserted into the playing surface vertically. As the low exit resistance region (100) enters the turf it slices through the ground and pushes the dirt aside. The configuration of the LERR insertion edge (200) is very important to the manner in which the dirt is pushed aside. After all, the low ground resistance golf tee (10) must be stable enough that it does not fall over under the weight of the golf ball, or the force of a brisk breeze; yet the low exit resistance region (100) must displace the dirt in preferred manner such that the low ground resistance golf tee (10) pivots forward as seen in FIG. 2 when the ball is struck, and pivots forward with the least amount of resistance.

Little research has been done to date regarding the effect that a golf tee has on the flight of a golf ball, which explains why modern golf tees are largely the same as the tees of decades ago. Often golfers ignore the effect that the golf tee has on the flight of the golf ball under the premise that the golf club strikes the ball first and then the tee; while this is true, there is a complex interaction between the ball and the tee when the ball is hit. For instance, occasionally a conventional golf tee will remain in the ground, exactly where it was initially placed, after the ball has been hit without breaking the tee. The golf ball was not picked clean off the tee without the golf club eventually hitting the tee; but rather the tee was briefly forced forward as the ball left the tee and the club head passed the tee, with the golf tee returning to the initial position. However, more commonly the golf tee breaks when it is struck by the golf club. As one skilled in the art will appreciate, most good golfers swing a golf club at over 100 miles per hour (mph) resulting in a collision with the golf ball that causes compression of the golf ball and deflection of the face of the golf club head; and this all occurs with the golf ball in contact with the club face for only about 450 microseconds (0.00045 s), much less time than it takes to blink your eye. During impact the club head exerts an average force in excess of 2,000 pounds on the ball, compressing it about one-fourth of its diameter. Therefore, it is perceptive to deduce that a golf tee's resistance against a ball or a club does have an impact on the flight of the golf ball.

The present invention recognizes this and incorporates a design that has an engineered pivot point created by the design of the low exit resistance region (100), thereby allowing the low ground resistance golf tee (10) to pivot forward with the least possible amount of resistance asserted on the golf ball or the golf club head. Additionally, the current design is such that it seeks to minimize the distance that the low ground resistance golf tee (10) ends up from the original teeing location.

First, the design of the low exit resistance region (100) creates an engineered pivot point. The unique combination of the LERR translation resistance surface (300) and the LERR insertion edge (200) allows the present invention to pivot forward, or lay down, as seen in FIG. 2, with virtually no resistance when compared to conventional golf tees. The design of the low exit resistance region (100) seeks to promote the rotation of the golf tee (10) as seen in FIG. 2 and does so in part by ensuring that the LERR insertion edge can rotate about the pivot point without having to move through undisturbed soil. In other words, when the low exit resistance region (100) is forced into the ground it displaces the soil and creates a slot through which the LERR insertion edge (200) may move, when the ball is struck, with minimal resistance and without encountering soil that was not displaced when the low exit resistance region (100) was inserted. Thus, the LERR translation resistance surface (300) is designed to provide enough resistance that the golf tee (10) is not going to simply translate forward in the flight direction, rather the golf tee (10) is going to pivot forward as seen in FIG. 2 with the low exit resistance region (100) simply exiting the soil through the same hole that was created when it was inserted into the ground.

Although the figures illustrate the LERR translation resistance surface (300) as a generally flat surface perpendicular to the flight direction, that is not required and the present invention is not limited to such. Further, certain embodiments of the LERR translation resistance surface (300) may include friction enhancing features. Such friction enhancing features on the LERR translation resistance surface (300) would not increase the resistance to pivoting forward, as that would be undesirable; rather once the golf tee (10) has pivoted to the position shown in FIG. 2 the friction enhancing features would have a tendency to increase the friction between the LERR translation resistance surface (300) and the surrounding environment, such as grass and soil, thereby further limiting the distance that the golf tee (10) travels.

Another feature of the present invention that limits the distance that the golf tee (10) travels is the unique weight distribution of the golf tee (10). For instance, in one embodiment seen in FIG. 4 the center of gravity (80) is located between the tee midpoint (72) and the insertion end (50), which is contrary to conventional golf tees that have more weight toward the golf ball support end of the tee. Ensuring that the golf tee (10) has a majority of its mass toward the insertion end (50) further minimizes the distance that the golf tee (10) travels. In yet a further embodiment, seen in FIG. 7, the center of gravity (80) is located within the low exit resistance region (100). Further, one skilled in the art will appreciate that the mass distribution of the golf tee (10) may be such that the center of gravity (80) is not located in the stem region (400) or the low exit resistance region (100), as seen in FIG. 12.

Additionally, the embodiments of the present invention having forward projections in the low exit resistance region (100) such as seen in FIG. 15, may preferably move the center of gravity (80) toward the location on the release side (40) about which rotation of the golf tee (10) is desired. Adjusting the mass properties to achieve a desired location of the center of gravity (80) may be done through the use of varying the material properties of the golf tee (10) through the selective use of additives, such as tungsten, in the materials; through the use of distinctly different materials; through the selective use of high-density paints or coatings; through the use of a partially hollow stem region (400); or even through the use of weight plugs; just to name a few of the number of possible methods of adjusting the location of the center of gravity (80). The embodiment of FIG. 17 illustrates the location of the center of gravity (80) coinciding with the point about which it is desired that the golf tee (10) rotates.

In yet another further embodiment the center of gravity (80) is located in a vertical region parallel to the longitudinal axis (90) between the elevation of the insertion edge aft termination point (220) and the insertion end (50), as illustrated in FIGS. 7, 13, and 14. Still a further embodiment identifies a unique range of center of gravity (80) locations, wherein the center of gravity (80) is located vertically in the direction of the longitudinal axis less than twice the stem region minimum width (420) from the insertion edge aft termination point (220), as seen in FIG. 18. In this embodiment, the center of gravity (80) may be above or below the insertion edge aft termination point (220) by a distance of up to twice the stem region minimum width (420), and may translate forward or backward anywhere in the flight direction or the rebound direction.

In furtherance of the desired performance of the present golf tee (10), one embodiment seen in FIG. 16 has a LERR max projection stem-to-tip dimension (130) that is less than 35 percent of the tee length (70). The design of the present invention allows for such a shallow penetration depth into the playing surface, while still providing the stability that golfers demand.

Yet a further embodiment of the present invention focuses on a preferred configuration of the LERR insertion edge (200), more specifically the widths (212, 222) of the LERR insertion edge (200). While some embodiments do include a knife-edge finish all the way along the LERR insertion edge (200) from the leading insertion point (210) to the insertion edge aft termination point (220), some embodiments increase the width of the LERR insertion edge (200) as it approaches the insertion edge aft termination point (220) to further minimize ground resistance. One such embodiment is seen in FIG. 8 and has an insertion edge aft termination width (222) of the LERR insertion edge (200) that is at least twice as large as the leading insertion width (212) of the LERR insertion edge (200). Such a configuration ensures that the leading insertion point (210) and the LERR insertion edge (200) encounter minimal contact with soil as the golf tee (10) pivots as seen in FIG. 2.

Further embodiments even more aggressively change the width of the LERR insertion edge (200) resulting in initial-to-aft width ratios of 5 or more. These embodiments minimize ground resistance encountered by shots that knock the golf tee (10) down with less than optimal direction. In other words, the average golfer may not be able to produce a repeatable swing that consistently knocks the golf tee (10) straight forward; rather, the average golfer's swing has some outside-in swing path attributes and the present embodiment recognizes this and provides extra clearance for the leading edge insertion point (210) as it pivots out of the ground in a direction other than the intended flight direction. In one particular embodiment the insertion edge aft termination width (222) is equal to the stem region minimum width (420). Still further, another embodiment recognizes a performance relationship offered when the insertion edge aft termination width (222) of the LERR insertion edge (200) is at least twice as large as the leading insertion width (212) of the LERR insertion edge (200), and the insertion edge aft termination width (222) of the LERR insertion edge (200) is at least 50 percent of the stem region minimum width (420). In yet another embodiment balancing performance and manufacturability, the insertion edge aft termination width (222) of the LERR insertion edge (200) is equal to the stem region minimum width (420).

The shape of the LERR insertion edge (200) also plays an important role in ensuring the golf tee (10) reacts in the desired manner. For instance, the LERR insertion edge (200) could be a straight line connecting the leading insertion point (210) to the insertion edge aft termination point (220); however, this triangular low exit resistance region (100) embodiment would result in the leading insertion point (210) having to travel through soil that was not displaced when the golf tee (10) was inserted into the playing surface, thereby adding resistance to the pivoting of the golf tee (10). The LERR insertion edge (200) should be a convex edge connecting these two points, as such convexity significantly decreases the likelihood of the leading insertion point (210) having to travel through previously undisturbed soil. In fact, in one such embodiment the LERR insertion edge (200) is an arc connecting the leading insertion point (210) to the insertion edge aft termination point (220). Further, one specific embodiment of this arc shaped LERR insertion edge (200) connecting the leading insertion point (210) to the insertion edge aft termination point (220) is one quarter of a circle, as seen in FIGS. 1 and 2. This embodiment ensures that the leading insertion point (210) will not have to travel through soil that was not displaced when the golf tee (10) was inserted into the playing surface.

Further embodiments more specifically define the arc of the LERR insertion edge (200) in terms of the radius of the arc. For instance, one embodiment has a radius of the arc connecting the leading insertion point (210) to the insertion edge aft termination point (220) that is at least double the stem region minimum width (420). By way of example only, and not limitation, the radius of the arc connecting the leading insertion point (210) to the insertion edge aft termination point (220) may be 0.50 inches, 0.75 inches, 0.84 inches, or any number of other sizes.

Next, additional embodiments further specify unique attributes that provide the present golf tee (10) the necessary stability, while not increasing the ground resistance. For instance, one further embodiment of the present invention has an LERR max projection from the longitudinal axis dimension (120) that is at least 0.63 inches, which is 75 percent of the radius of a golf ball. This value provides the stability of a relatively long projection in the playing surface, while also appreciating certain limitations regarding the size of the golf ball and a golfer's desire not to be distracted by seeing anything other than the golf ball at address. Further, this value takes into consideration the previously mentioned compression of the golf ball upon impact by the golf club.

Other embodiments provide stability in terms of the LERR max front-to-back dimension (110). One such embodiment incorporates a LERR max front-to-back dimension (110) that is at least double the stem region minimum width (420). A further such embodiment has a LERR max front-to-back dimension (110) that is at least 0.84 inches, or at least one half the diameter of a golf ball. Yet a further embodiment introduces a cap on the LERR max front-to-back dimension (110) such that it is at least 0.84 inches, but less than 1.68 inches, again appreciating a golfer's desire for a clean view of the golf ball at address without additional distractions of golf tee components.

Yet further embodiments address the stability issue from the perspective of the depth that a portion of the golf tee (10) is inserted into the playing surface. For instance one such embodiment has a LERR max projection stem-to-tip dimension (130) that is at least double the stem region minimum width (420). A further embodiment limits the depth of penetration with a LERR max projection stem-to-tip dimension (130) of less than 0.84 inches, thus less than the radius of a golf ball, which is an amount that feels natural to most golfers, not too shallow and not too deep. Yet another embodiment has a LERR max projection stem-to-tip dimension (130) that is at least double the stem region minimum width (420) and less than 0.84 inches.

Still further, in one embodiment of the present invention the volume of the low exit resistance region (100) is at least 40 percent of the volume of the entire golf tee (10), which is contrary to conventional golf tee designs. Having such a large volume inserted into the playing surface provides the stability required, while the design of the present invention facilitates the pivoting, or laying down, of the golf tee (10) with minimal ground resistance, something unseen in the prior art. Further, rather than looking at the mass distribution of the present golf tee (10) in terms of the center of gravity (80), sometimes it is more easily understood in terms of which portion of the golf tee (10) contain the greatest mass. From this perspective, one embodiment of the present golf tee (10) has at least 50 percent of the mass of the entire golf tee (10) found in the low exit resistance region (100); thus leading to a center of gravity (80) that is between the tee midpoint (72) and the insertion end (50) and affording the golf tee (10) all the benefits previously discussed with respect to this mass distribution. Still further, another embodiment has a mass distribution that leads to the mass of the low exit resistance region (100) being at least 65 percent of the mass of the entire golf tee (10); thus, this embodiment provides a center of gravity (80) even closer to the insertion end (50) than the prior embodiment.

As previously touched upon, numerous embodiments incorporate variations of the LERR translation resistance surface (300) while still providing, and enhancing, the benefits of the low ground resistance golf tee (10). For instance, while the embodiment of FIG. 6 illustrates a LERR translation resistance surface (300) that is parallel to the longitudinal axis (90) and perpendicular to the flight direction, this is just one embodiment and the present invention is not limited to this configuration. For instance, the embodiment of FIG. 11 illustrates the LERR translation resistance surface (300) having a translation resistance surface angle (320) that is at least 45 degrees. The forward projection of the LERR translation resistance surface (300) aids in achieving a beneficial mass distribution of the golf tee (10), as well as providing additional stability while not increasing the ground contact resistance as the golf tee (10) pivots down when the golf ball is struck.

Figure 22:
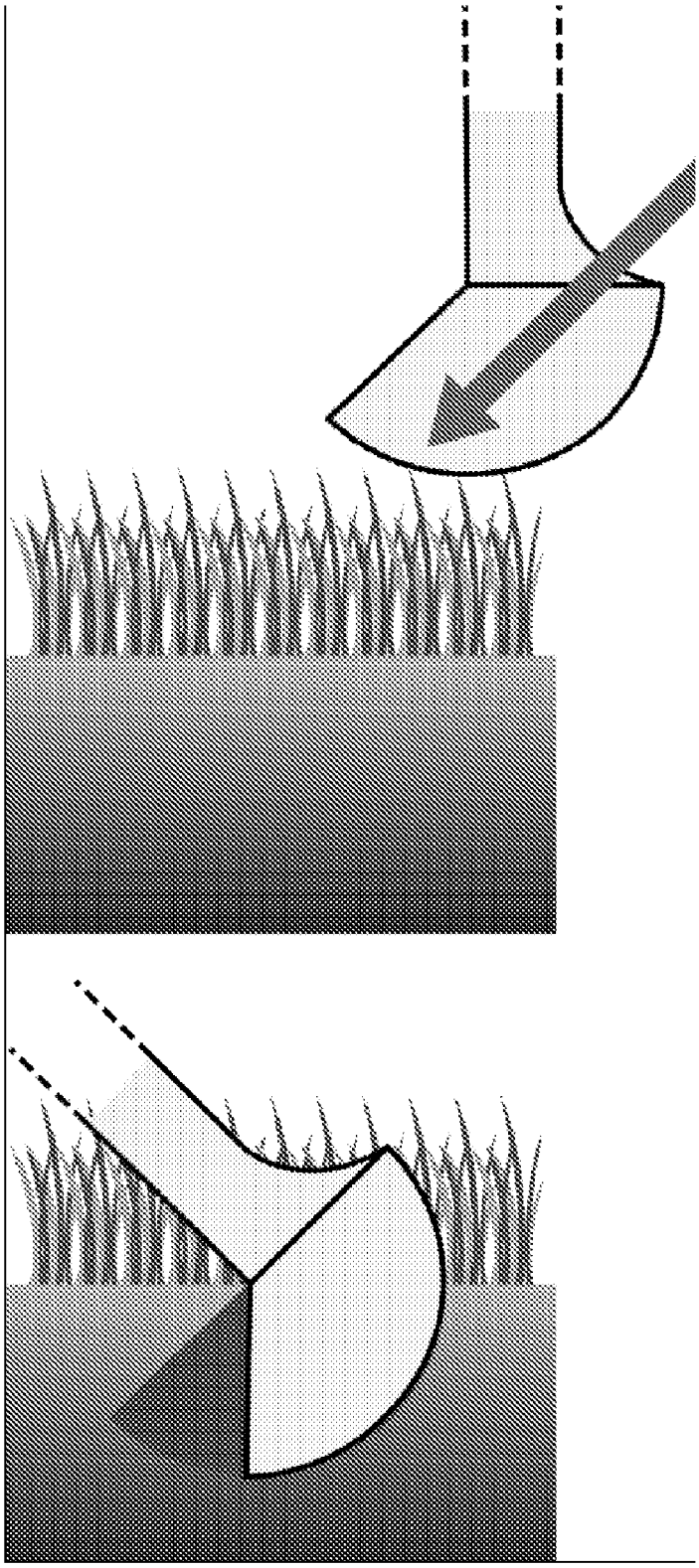
FIG. 22 is a partial side elevation view of one embodiment of the present invention, not to scale.
Figure 23:
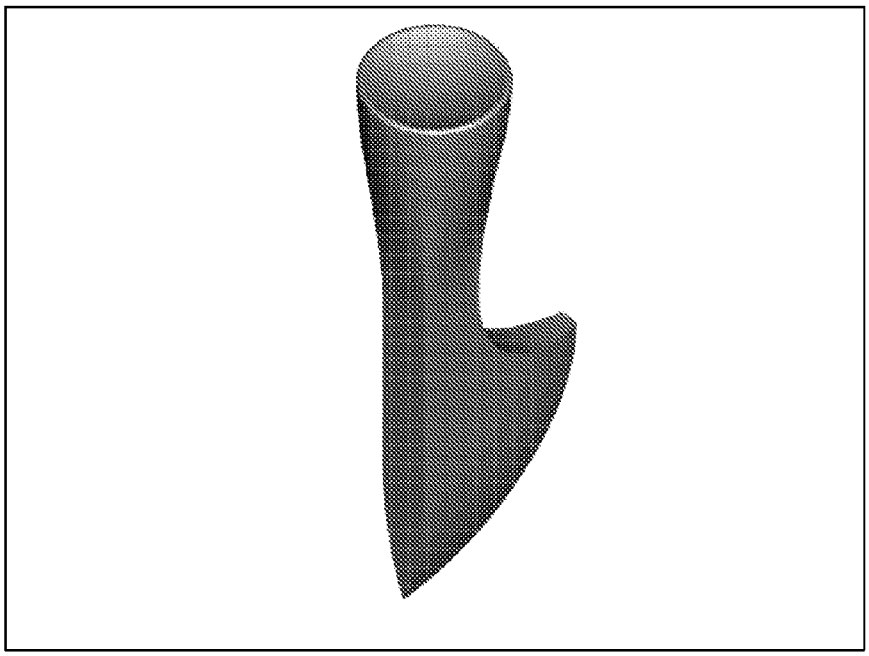
FIG. 23 is an elevated perspective view of one embodiment of the present invention, not to scale.
Figure 24:
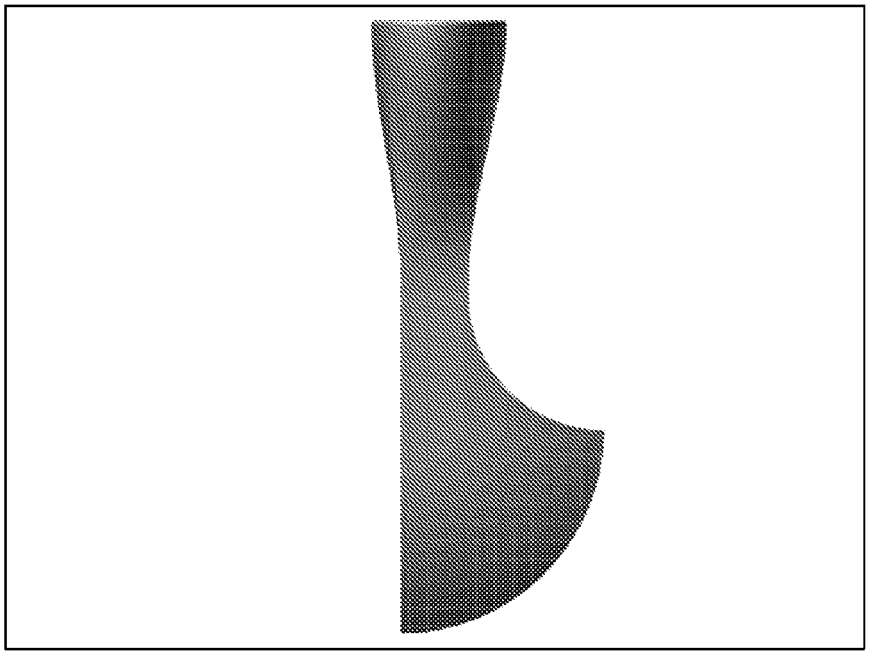
FIG. 24 is a side elevation view of one embodiment of the present invention, not to scale.
Figure 29:
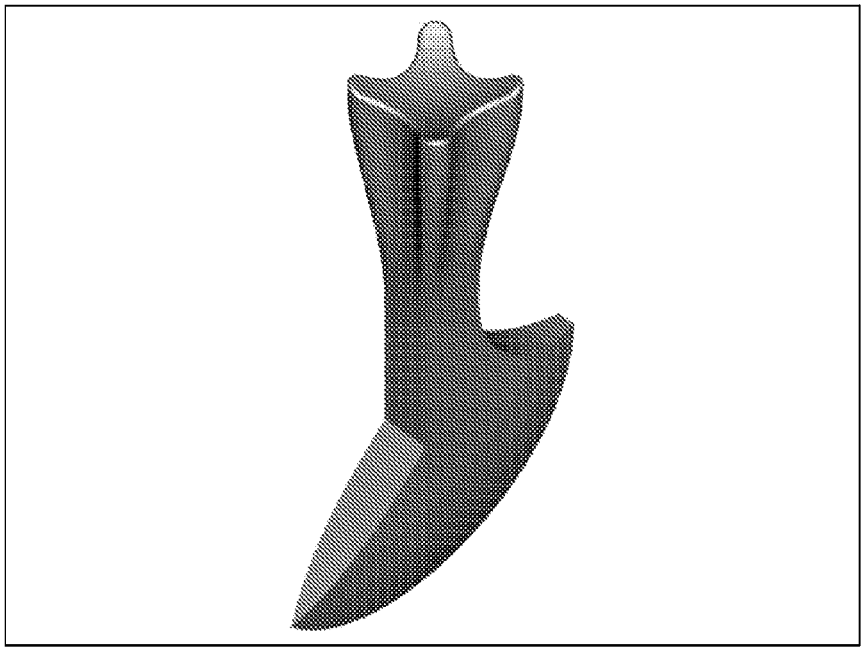
FIG. 29 is an elevated perspective view of one embodiment of the present invention, not to scale.
Figure 30:
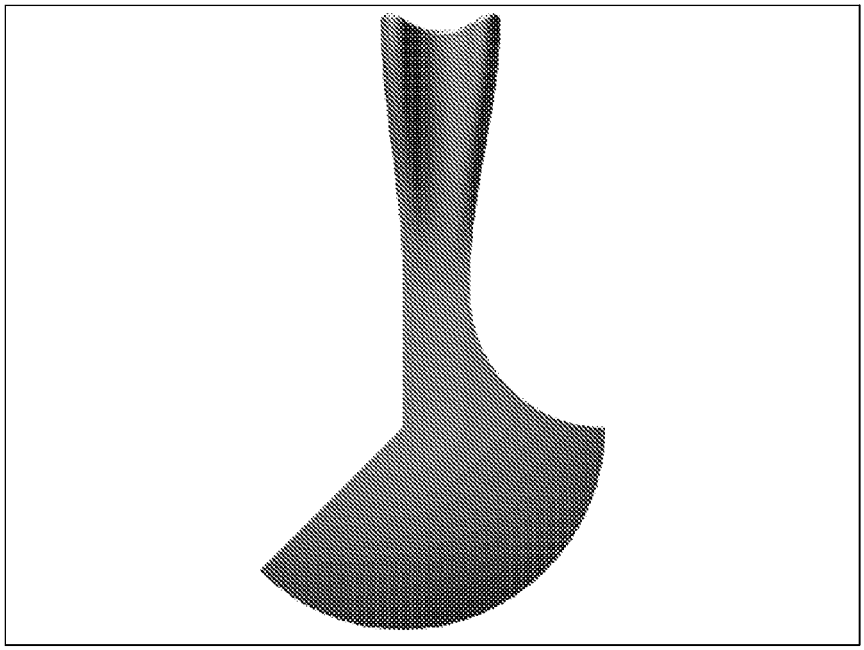
FIG. 30 is a side elevation view of one embodiment of the present invention, not to scale.

An additional benefit of the embodiment having a LERR translation resistance surface (300) with a translation resistance surface angle (320) that is greater than zero degrees is that a portion of the low exit resistance region (100) remains in the playing surface even when the golf tee (10) has pivoted forward during impact, as seen in FIG. 22. In this embodiment, a portion of the low exit resistance region (100) will remain in the playing surface even when the golf tee (10) has pivoted to the extent of having the longitudinal axis (90) parallel with the ground. While this advantageously has no effect on the resistance during pivoting, it does further minimize the travel of the golf tee (10) from the original teeing location because the portion of the low exit resistance region (100) remaining in the playing surface has to be dragged out of the hole, thereby reducing the golf tee's (10) momentum.

Yet another embodiment has a maximum LERR resistance surface width (314) that is at least equal to the stem region minimum width (420). This is illustrated in FIG. 19, with reference to FIG. 9 for the maximum LERR resistance surface width (314). Such an embodiment benefits from a uniform transition on the release side (40) of the golf tee (10) providing improved manufacturability and allowing some adjustability to the player that chooses to insert the golf tee (10) into the playing surface such that the insertion edge aft termination point (220) is below the playing surface. As seen in a majority of the illustrated embodiments, it is preferred that the LERR translation resistance surface width (310) transitions from the maximum LERR resistance surface width (314) nearest the stem region (400) to the minimum LERR resistance surface width (312) at the intersection with the LERR insertion edge (200).

The appearance of the low ground resistance golf tee (10) is definitely unique; however, the design is all about minimizing the ground resistance so that the golf tee (10) gets out of the way when the ball is struck. Fortunately, the stem region (400) may be designed to provide golfers with a look that they are familiar with, without sacrificing performance. As such, one embodiment incorporates a stem region (400) that is symmetric about the longitudinal axis (90) for at least 50 percent of the stem region length (410) beginning at the ball support end (60). In yet a further embodiment, the stem region (400) is symmetric about the longitudinal axis (90) for at least 75 percent of the stem region length (410) beginning at the ball support end (60). The primary limitation to the length of the symmetry is the transition region height (610) seen in FIG. 21. A smooth SR transition region (600) is preferred over a jagged, or abrupt, transition region (600) so that points of high stress concentration are avoided, thereby extending the life of the golf tee (10). Yet a further embodiment, seen in FIG. 19, identifies a relationship that leads to extended life of the golf tee (10); namely enhanced durability is offered when the stem region minimum front-to-back dimension (430) is at least as large as the stem region minimum width (420). Even more preferably, in another embodiment the stem region minimum front-to-back dimension (430) is at least twice as large as the stem region minimum width (420), further reducing the likelihood that the golf tee (10) breaks upon impact.

Figure 35:
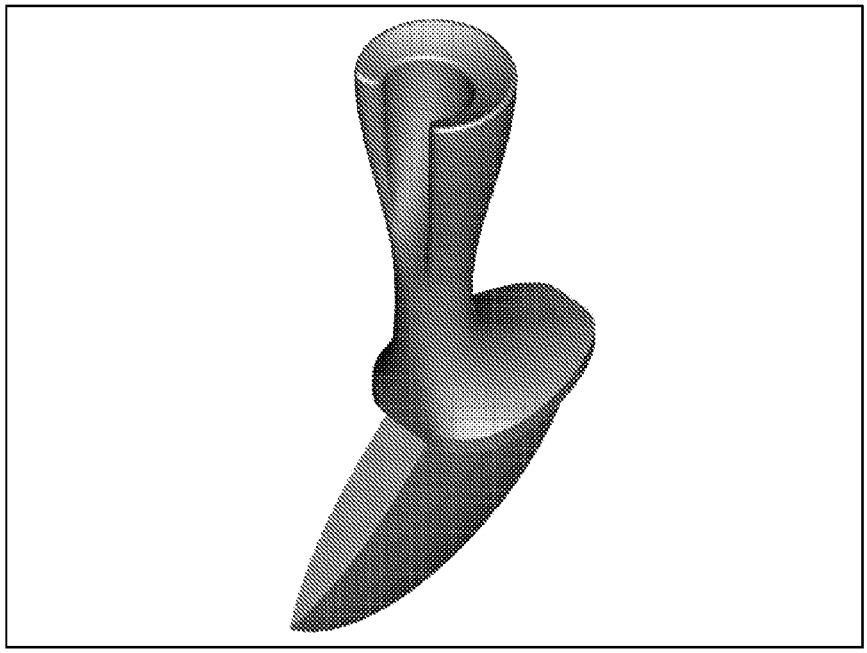
FIG. 35 is an elevated perspective view of one embodiment of the present invention, not to scale.
Figure 36:
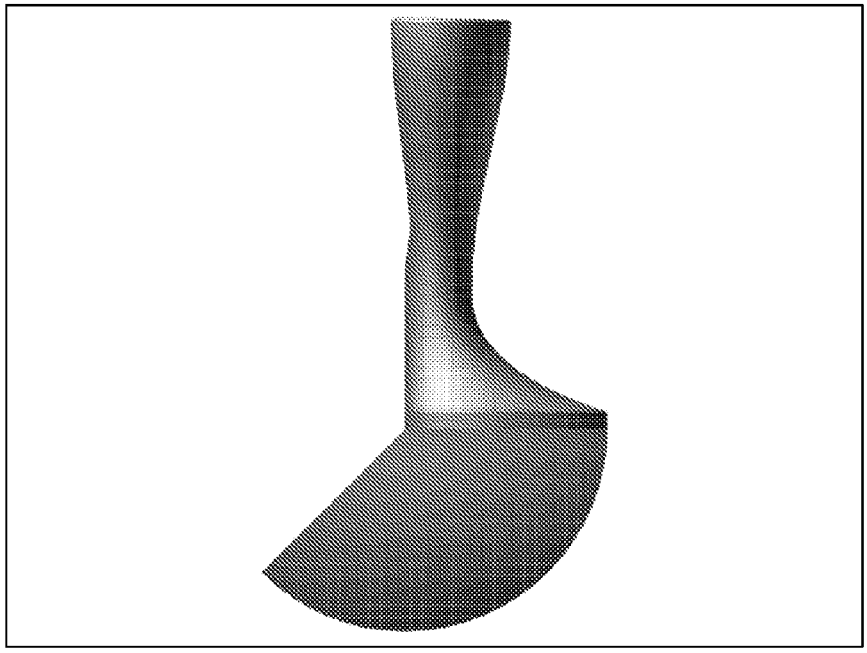
FIG. 36 is a side elevation view of one embodiment of the present invention, not to scale.
Figure 41:
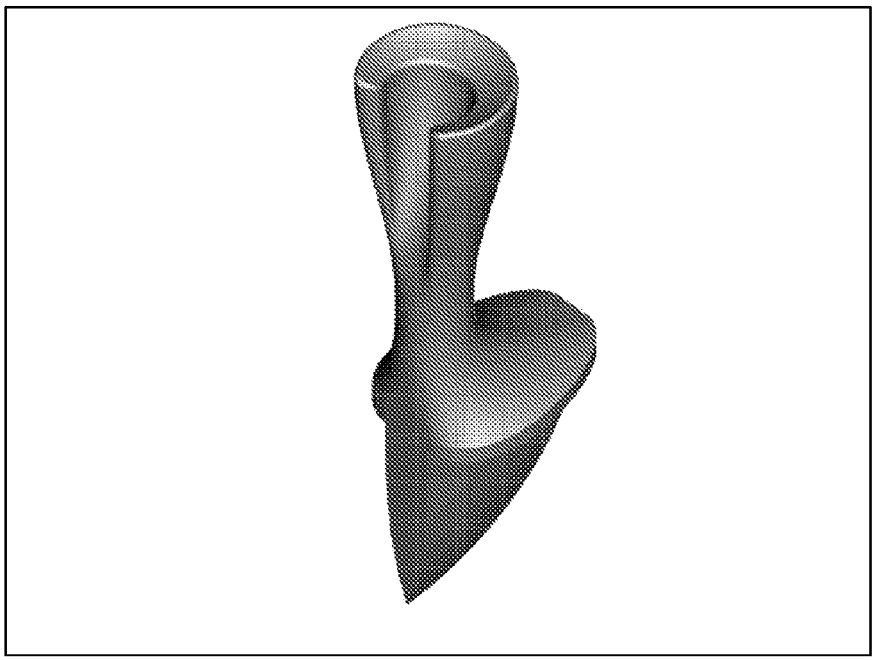
FIG. 41 is an elevated perspective view of one embodiment of the present invention, not to scale.
Figure 42:
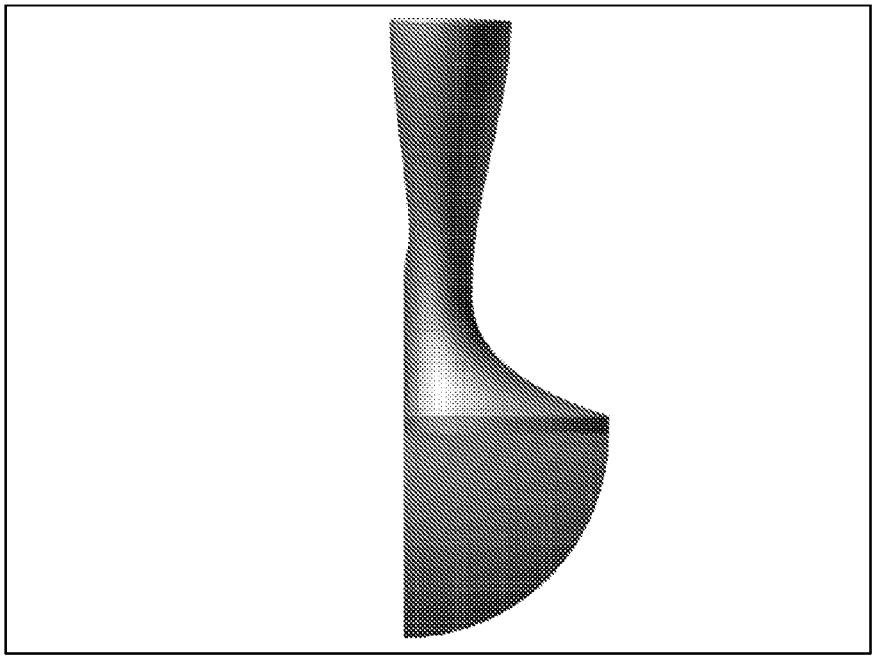
FIG. 42 is a side elevation view of one embodiment of the present invention, not to scale.
Figure 47:
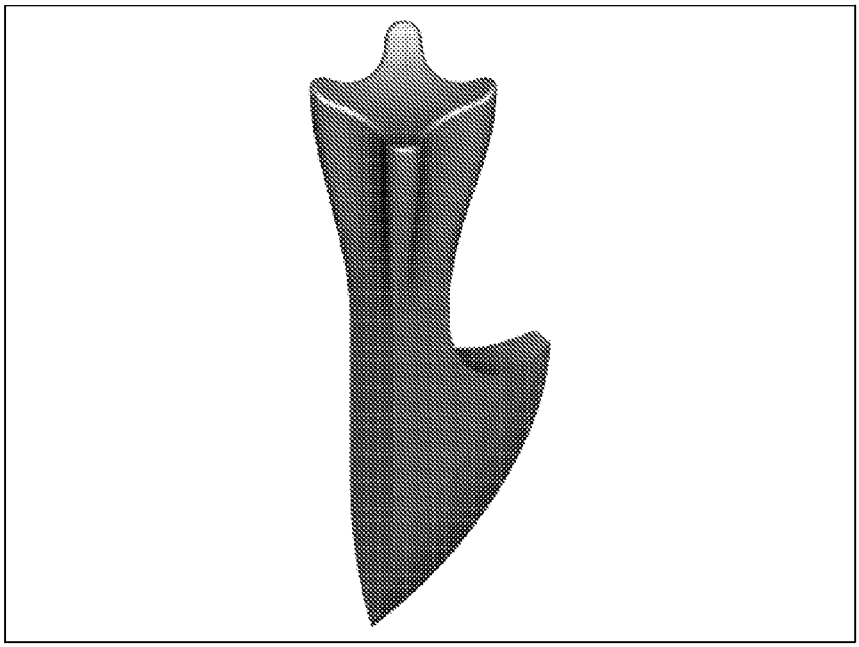
FIG. 47 is an elevated perspective view of one embodiment of the present invention, not to scale.
Figure 48:
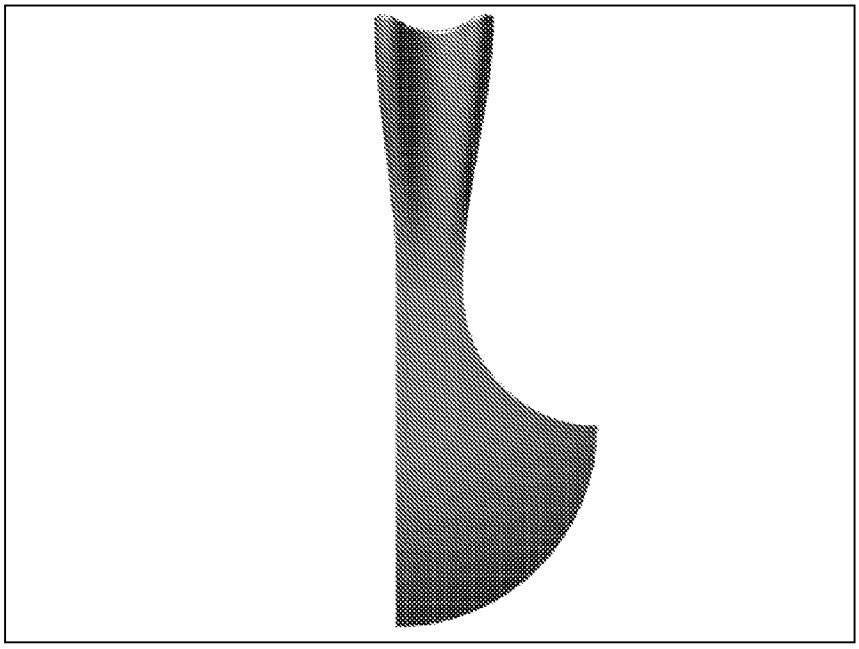
FIG. 48 is a side elevation view of one embodiment of the present invention, not to scale.
Figure 53:
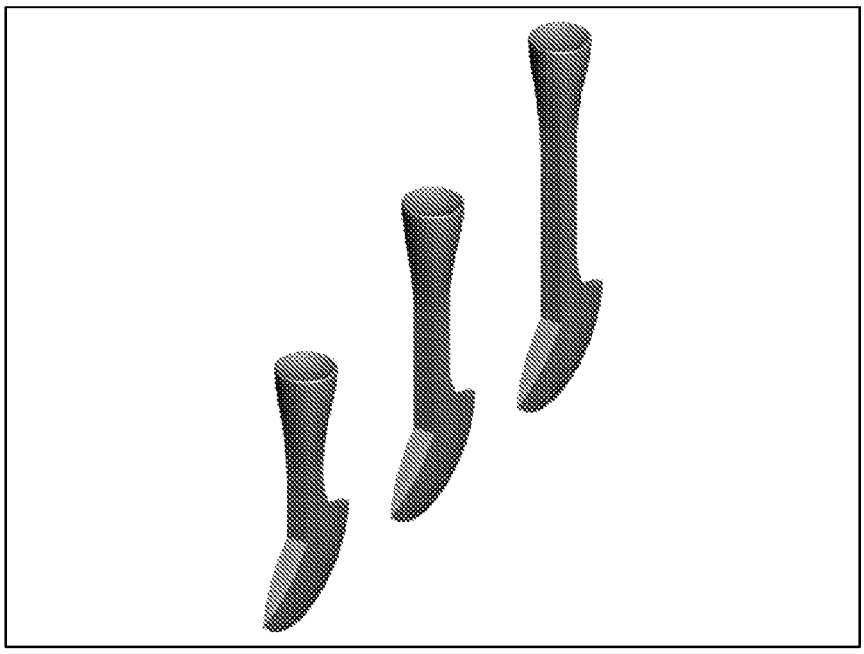
FIG. 53 is an elevated perspective view of several embodiments of the present invention in varying length, not to scale.
Figure 54:
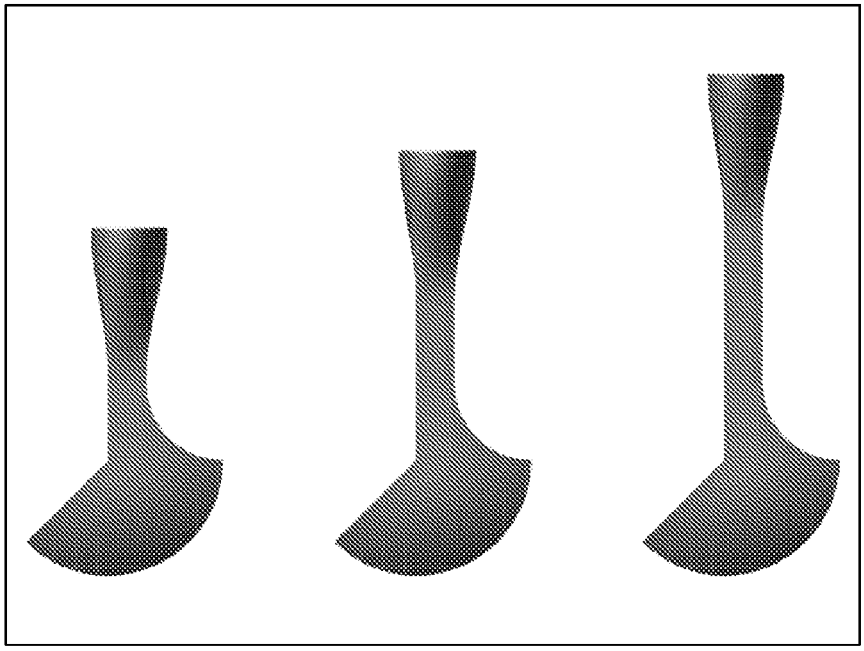
FIG. 54 is a side elevation view of several embodiments of the present invention in varying length, not to scale.
Figure 55:
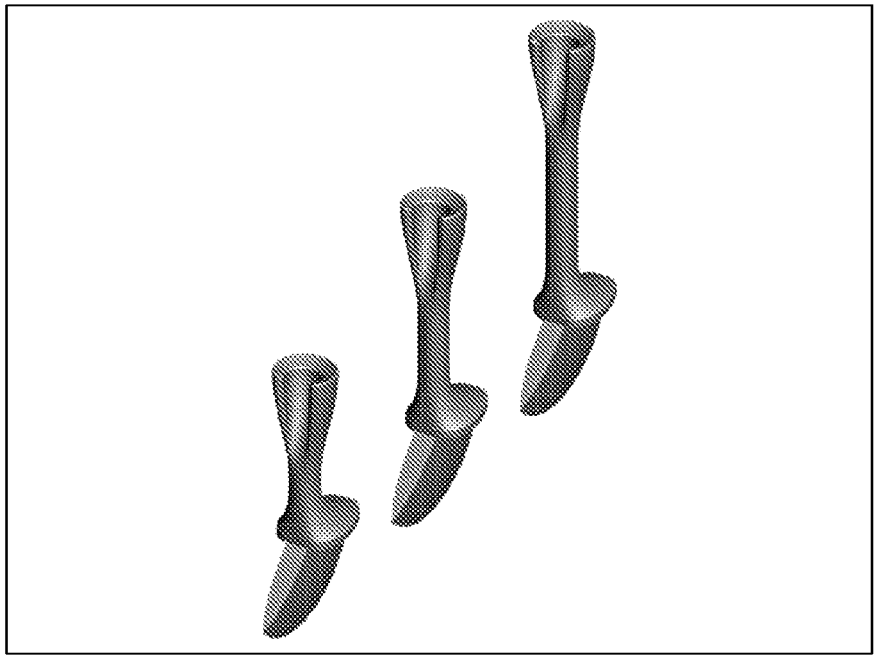
FIG. 55 is an elevated perspective view of several embodiments of the present invention in varying length, not to scale.
Figure 56:
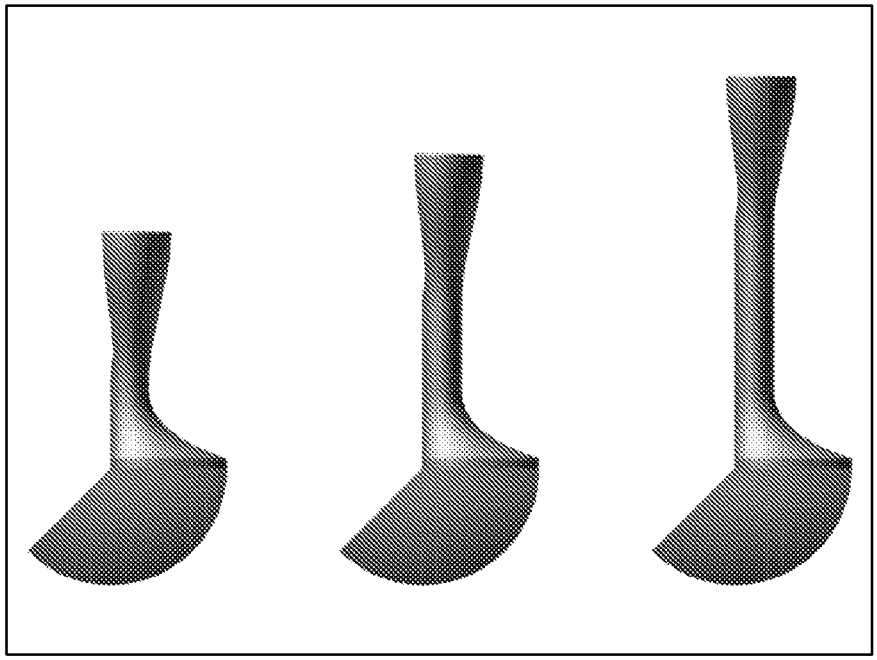
FIG. 56 is a side elevation view of several embodiments of the present invention in varying length, not to scale.
Figure 57:
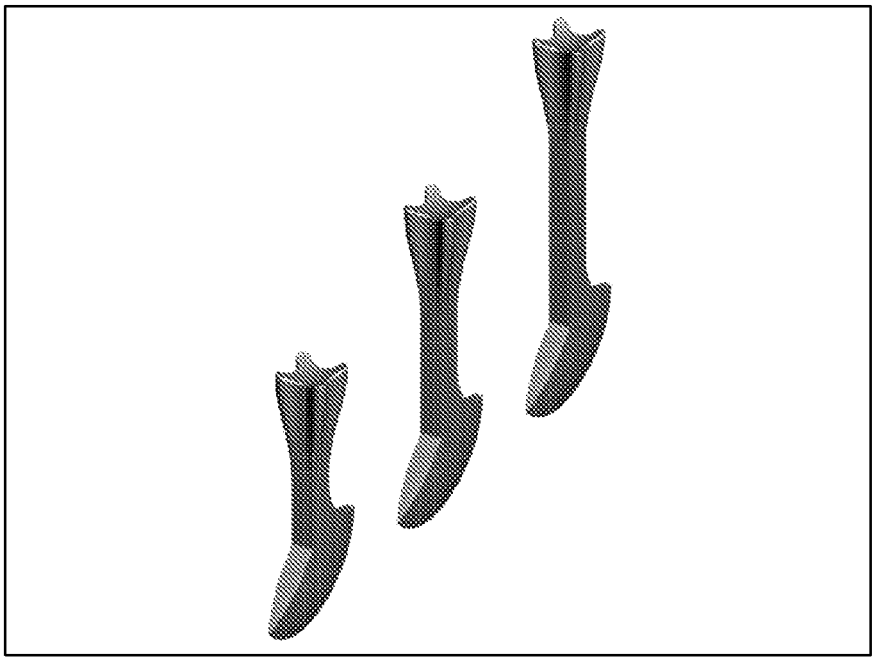
FIG. 57 is an elevated perspective view of several embodiments of the present invention in varying length, not to scale.
Figure 58:
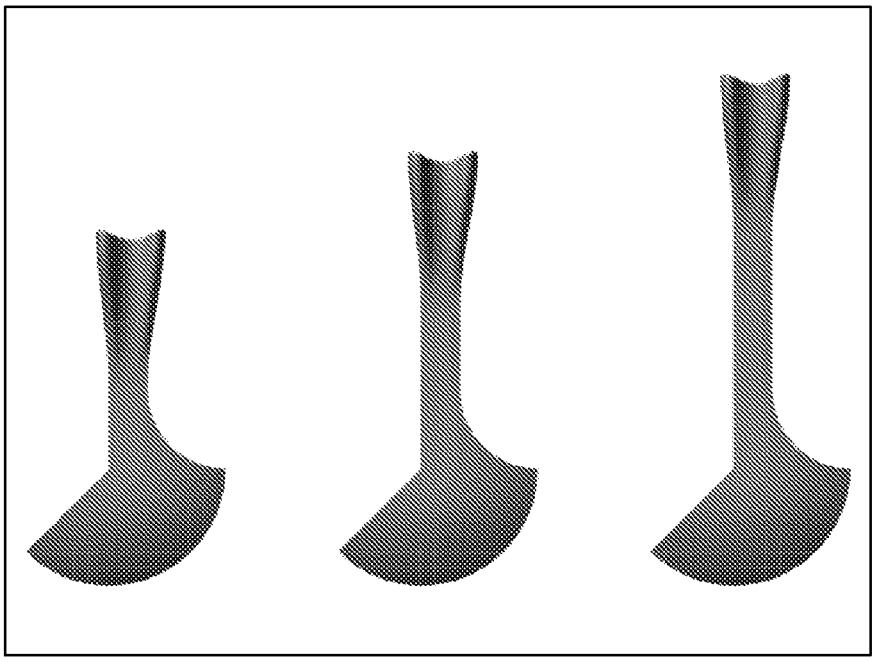
FIG. 58 is a side elevation view of several embodiments of the present invention in varying length, not to scale.
Figure 59:
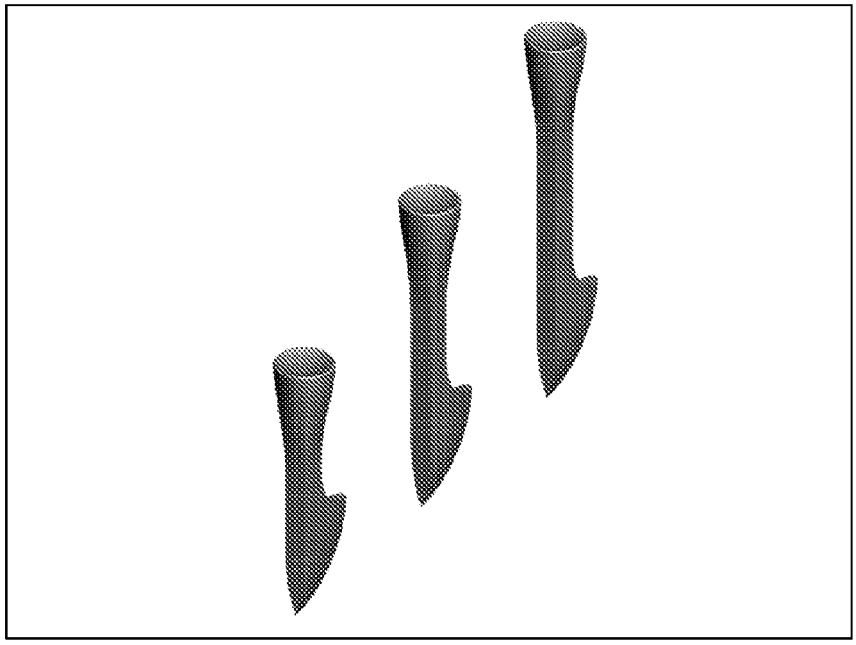
FIG. 59 is an elevated perspective view of several embodiments of the present invention in varying length, not to scale.
Figure 60:
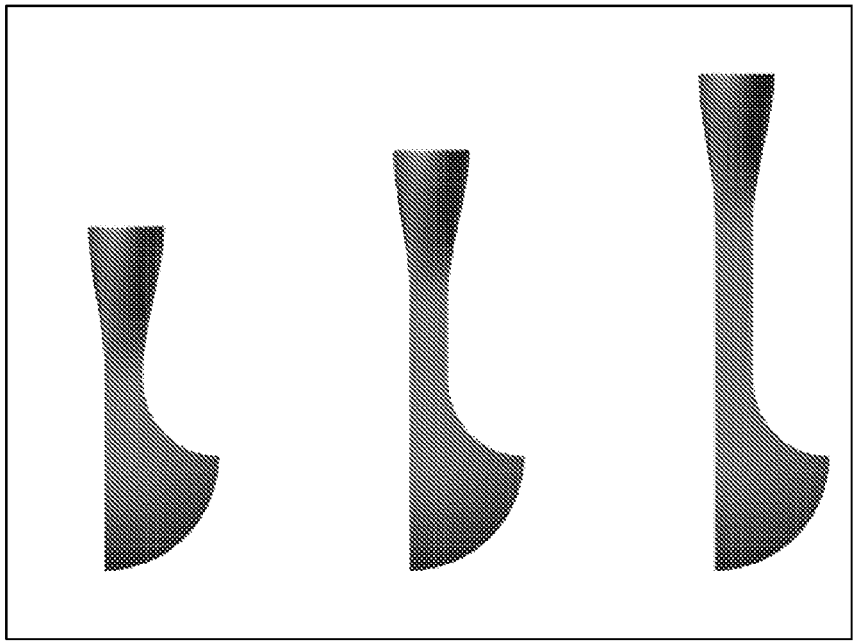
FIG. 60 is a side elevation view of several embodiments of the present invention in varying length, not to scale.
Figure 61:
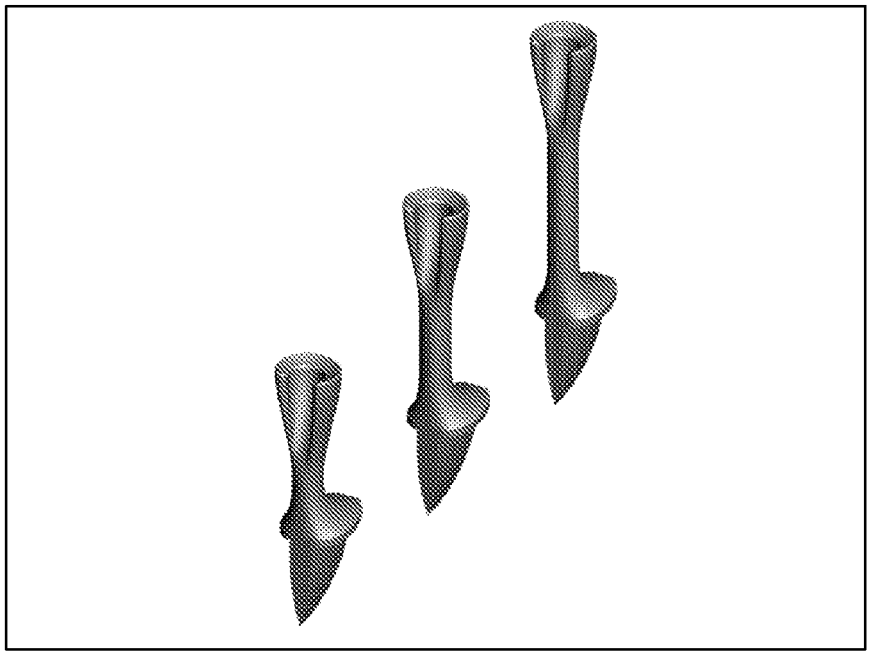
FIG. 61 is an elevated perspective view of several embodiments of the present invention in varying length, not to scale.
Figure 62:
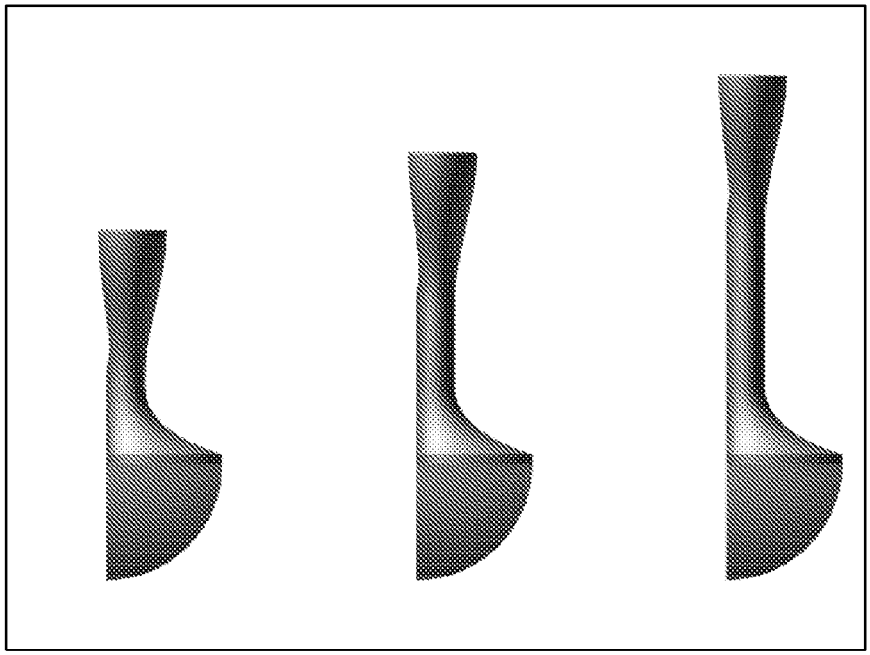
FIG. 62 is a side elevation view of several embodiments of the present invention in varying length, not to scale.
Figure 63:
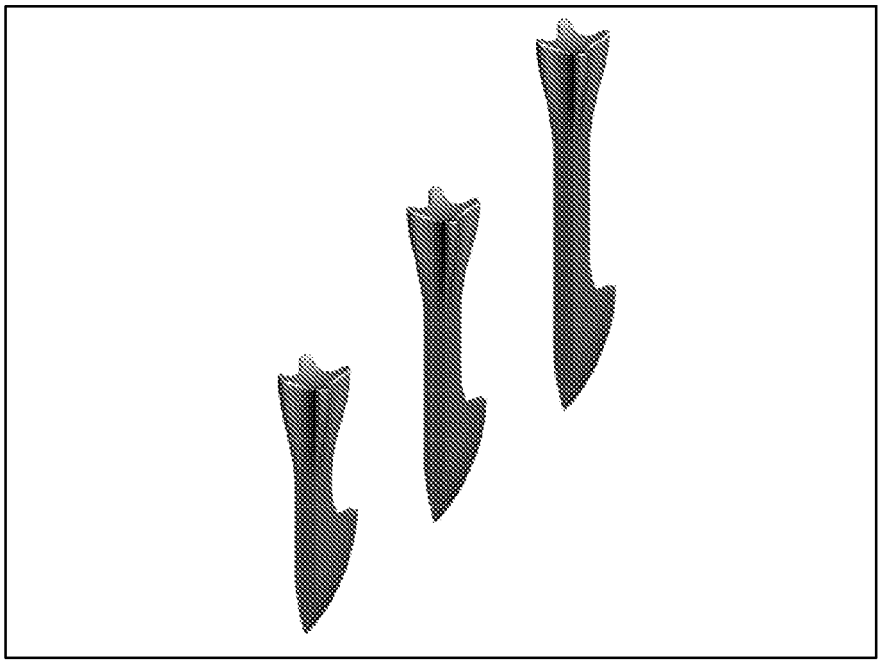
FIG. 63 is an elevated perspective view of several embodiments of the present invention in varying length, not to scale.
Figure 64:
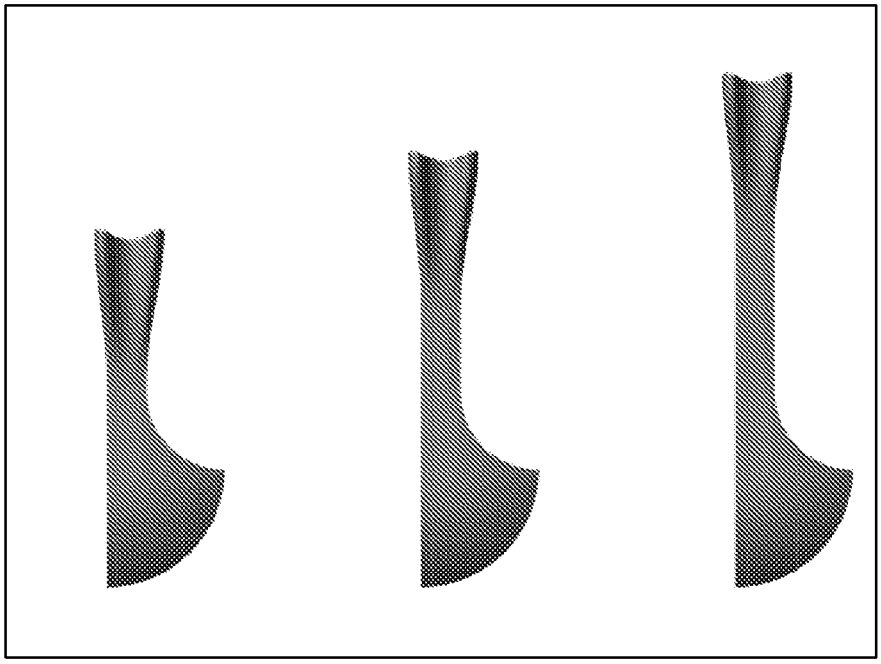
FIG. 64 is a side elevation view of several embodiments of the present invention in varying length, not to scale.
Figure 65:
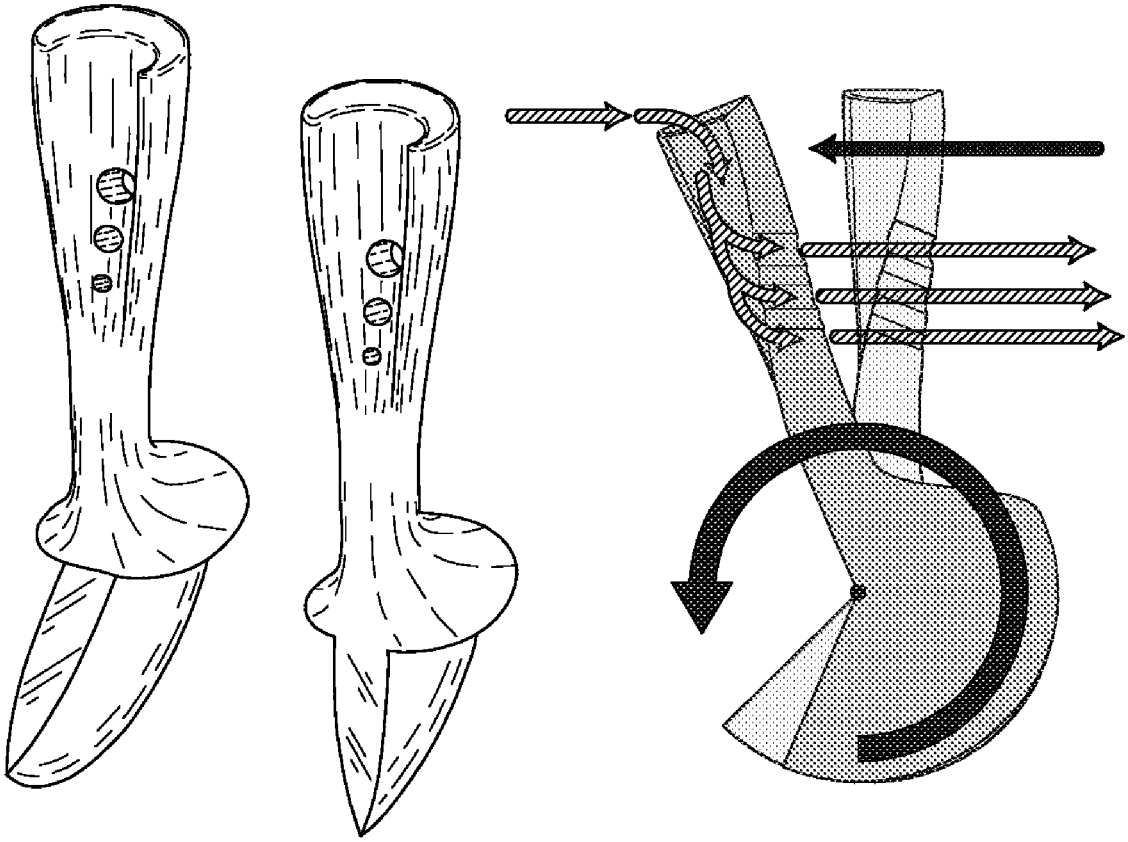
FIG. 65 is an elevated perspective view of several embodiments of the present invention as well as a side elevation view schematic of an embodiment of the present invention, not to scale.

The stem region (400) of the present invention has a stem region cross-sectional profile in a plane perpendicular to the longitudinal axis (90), not illustrated but as would be understood by one skilled in the art. In one particular embodiment, the stem region cross-sectional profile varies throughout a portion of the stem region length (410) with at least one point having a stem region cross-sectional profile that is not circular, as is the case in the embodiment illustrated in FIG. 6. Further, another embodiment of the stem region (400) has a stem region cross-sectional profile that is not circular over at least 50 percent of the stem region length (410). Still further, another embodiment has a stem region (400) with a stem region cross-sectional profile that varies throughout a portion of the stem region length (410) and has at least one point with a stem region cross-sectional profile that is horseshoe shaped, as seen in the embodiments FIGS. 35 and 41. These embodiments have the additional benefit of preferentially channeling the airflow as the golf tee (10) pivots at impact. Such preferential airflow channeling may be further used to reduce the golf tee's (10) resistance to pivoting at impact. Even further, these embodiments may incorporate engineered vents to further direct the airflow out the impact side (30) of the golf tee (10) as it rotates to further reduce the resistance, as seen in FIG. 65.

Numerous additional embodiments of the present invention are illustrated in FIGS. 23-64 and are incorporated herein. All of these embodiments incorporate the performance and structural characteristics outlined above and fall within the scope of the present invention.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative manufacturing processes and materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

I claim:

1. A low ground resistance golf tee (10) for insertion into a playing surface to support a golf ball above the playing surface to be struck by a golf club launching the golf ball in a flight direction, comprising:

a body (20) having an impact side (30), a release side (40), an insertion end (50), and a ball support end (60) separated from the insertion end (50) by a tee length (70) having a tee midpoint (72) equidistant from the insertion end (50) and the ball support end (60), the body (20) having a center of gravity (80) and a longitudinal axis (90) wherein the longitudinal axis (90) is a vertical axis extending through a center of the golf ball when supported by the golf tee (10), and wherein the golf tee (10) has:

(A) a low exit resistance region (100) located entirely between the tee midpoint (72) and the insertion end (50), and at least a portion of the low exit resistance region (100) is designed to penetrate the playing surface, wherein the low exit resistance region (100) includes:

(i) a low exit resistance region insertion edge (200) designed to penetrate and separate the playing surface to create a preferred exit path for the low exit resistance region (100) when the golf tee (10) is struck by the golf club, wherein the low exit resistance region insertion edge (200) includes:

(a) a leading insertion point (210) which is the furthest most point on the insertion end (50) and enters the playing surface first when the golf tee (10) is forced vertically down into the playing surface, wherein the leading insertion point (210) has a leading insertion width (212);

(b) an insertion edge aft termination point (220) at the termination of the low exit resistance region insertion edge (200), wherein the insertion edge aft termination point (220) has an insertion edge aft termination width (222);

(ii) a low exit resistance region translation resistance surface (300) that intersects with the low exit resistance region insertion edge (200), wherein the low exit resistance region translation resistance surface (300) has a low exit resistance region translation resistance surface width (310) and is oriented at a fixed translation resistance surface angle (320) with respect to the longitudinal axis (90);

(iii) a low exit resistance region max front-to-back dimension (110) measured in a direction perpendicular to the longitudinal axis (90) from the point of the low exit resistance region (100) farthest from the longitudinal axis (90) in the flight direction, to the point of the low exit resistance region (100) farthest from the longitudinal axis (90) in a rebound direction opposite the flight direction;

(iv) a low exit resistance region max projection from longitudinal axis dimension (120) measured in a direction perpendicular to the longitudinal axis (90) from the longitudinal axis (90) to the most distant point on the low exit resistance region (100);

(v) a low exit resistance region max projection stem-to-tip dimension (130) measured in a direction parallel to the longitudinal axis (90) from the leading insertion point (210) to the insertion edge aft termination point (220); and (B) a stem region (400) located between the low exit resistance region (100) and the ball support end (60), wherein the stem region (400) is designed to be displayed above the playing surface, wherein the stem region (400) includes:

(i) a stem region length (410) measured in a direction parallel to the longitudinal axis (90) from insertion edge aft termination point (220) to the ball support end (60);

(ii) a stem region minimum width (420) measured in a direction perpendicular to the flight direction;

(iii) a stem region minimum front-to-back dimension (430) measured in a direction parallel to the flight direction;

(iv) a stem region translation resistance surface (500) in communication with the low exit resistance region translation resistance surface (300), wherein the stem region translation resistance surface (500) is parallel to the longitudinal axis (90), and the stem region translation resistance surface (500) has a stem region translation resistance surface width (510) and a minimum stem region resistance surface width; and (v) a stem region transition region (600) joining the low exit resistance region insertion edge (200) to the stem region (400), wherein the stem region transition region (600) has a transition region height (610) measured in a direction parallel to the longitudinal axis (90) from insertion edge aft termination point (220) toward the ball support end (60); and wherein the center of gravity (80) is located between the tee midpoint (72) and the insertion end (50).

2. The low ground resistance golf tee (10) of claim 1, wherein the center of gravity (80) is located in a vertical region parallel to the longitudinal axis (90) between the elevation of the insertion edge aft termination point (220) and the insertion end (50).

3. The low ground resistance golf tee (10) of claim 1, wherein the center of gravity (80) is located vertically in the direction of the longitudinal axis less than twice the stem region minimum width (420) from the insertion edge aft termination point (220).

4. The low ground resistance golf tee (10) of claim 1, wherein the low exit resistance region max projection stem-to-tip dimension (130) is less than 35 percent of the tee length (70).

5. The low ground resistance golf tee (10) of claim 1, wherein the low exit resistance region insertion edge (200) transitions from a knife-edge configuration at the leading insertion point (210) to an insertion edge aft termination width (222) that is at least 50 percent of the stem region minimum width (420).

6. The low ground resistance golf tee (10) of claim 1, wherein the low exit resistance region insertion edge (200) is a continuous knife-edge configuration.

7. The low ground resistance golf tee (10) of claim 1, wherein the low exit resistance region insertion edge (200) is an arc connecting the leading insertion point (210) to the insertion edge aft termination point (220).

8. The low ground resistance golf tee (10) of claim 7, wherein the radius of the arc connecting the leading insertion point (210) to the insertion edge aft termination point (220) is at least double the stem region minimum width (420).

9. The low ground resistance golf tee (10) of claim 8, wherein the arc connecting the leading insertion point (210) to the insertion edge aft termination point (220) is one quarter of a circle.

10. The low ground resistance golf tee (10) of claim 1, wherein the low exit resistance region max front-to-back dimension (110) is at least double the stem region minimum width (420).

11. The low ground resistance golf tee (10) of claim 1, wherein the low exit resistance region max front-to-back dimension (110) is at least 0.84 inches.

12. The low ground resistance golf tee (10) of claim 1, wherein the low exit resistance region max projection stem-to-tip dimension (130) is less than 0.84 inches.

13. The low ground resistance golf tee (10) of claim 1, wherein the low exit resistance region max projection stem-to-tip dimension (130) is at least double the stem region minimum width (420) and less than 0.84 inches.

14. The low ground resistance golf tee (10) of claim 1, wherein the volume of the low exit resistance region (100) is at least 40 percent of the volume of the entire golf tee (10).

15. The low ground resistance golf tee (10) of claim 1, wherein the translation resistance surface angle (320) is at least 30 degrees.

16. The low ground resistance golf tee (10) of claim 1, wherein the low exit resistance region translation resistance surface width (310) transitions from the maximum low exit resistance region resistance surface width (314) nearest the stem region (400) to the minimum low exit resistance region resistance surface width (312) at the intersection with the low exit resistance region insertion edge (200).

17. The low ground resistance golf tee (10) of claim 1, wherein the insertion edge aft termination width (222) of the low exit resistance region insertion edge (200) is at least twice as large as the leading insertion width (212) of the low exit resistance region insertion edge (200), and the insertion edge aft termination width (222) of the low exit resistance region insertion edge (200) is at least 50 percent of the stem region minimum width (420).

18. The low ground resistance golf tee (10) of claim 17, wherein the insertion edge aft termination width (222) of the low exit resistance region insertion edge (200) is equal to the stem region minimum width (420).

19. The low ground resistance golf tee (10) of claim 1, wherein the stem region (400) has a stem region cross-sectional profile that varies throughout a portion of the stem region length (410), and at least one point has a stem region cross-section profile that is not circular.

* * * * *